US011554300B2

(12) United States Patent
Wright

(10) Patent No.: US 11,554,300 B2
(45) Date of Patent: Jan. 17, 2023

(54) CONFIGURABLE GOLFING APPARATUS

(71) Applicant: Timothy N. Wright, Kenosha, WI (US)

(72) Inventor: Timothy N. Wright, Kenosha, WI (US)

( * ) Notice: Subject to any disclaimer, the term of this patent is extended or adjusted under 35 U.S.C. 154(b) by 104 days.

(21) Appl. No.: 17/199,762

(22) Filed: Mar. 12, 2021

(65) Prior Publication Data

US 2022/0080271 A1 Mar. 17, 2022

Related U.S. Application Data

(60) Provisional application No. 63/077,810, filed on Sep. 14, 2020.

(51) Int. Cl.
*A63B 53/08* (2015.01)
*A63B 60/08* (2015.01)
(Continued)

(52) U.S. Cl.
CPC ..... *A63B 53/08* (2013.01); *A63B 24/0003* (2013.01); *A63B 53/02* (2013.01);
(Continued)

(58) Field of Classification Search
CPC ..... A63B 53/08; A63B 24/0003; A63B 53/02; A63B 60/08; A63B 60/16; A63B 71/0622;
(Continued)

(56) References Cited

U.S. PATENT DOCUMENTS 3,206,205 A * 9/1965 McLoughlin ..... A63B 53/00 473/307
4,441,837 A 4/1984 Mastroni
(Continued)

FOREIGN PATENT DOCUMENTS

AU 2013209683 A1 * 9/2014 ..... A61B 5/1036
WO WO-2014072784 A2 * 5/2014 ..... A63B 55/00
WO WO-2021074704 A1 * 4/2021

OTHER PUBLICATIONS

The Rules of Golf: R&A Limited and the United States Golf Association (USGA), 162 pp.
(Continued)

*Primary Examiner* — Jeffrey S Vanderveen
(74) *Attorney, Agent, or Firm* — Lesavich High-Tech Law Group, S.C.; Stephen Lesavich

(57) ABSTRACT

A configurable golfing apparatus including a rectangular handle portion. The rectangular handle portion includes a golf club shaft that is securely mounted within the configurable golf club handle. The rectangular shape provides new and additional hand placement and new and additional configuration capabilities for both right handed and left handed golfers. The configurable golfing apparatus allows different golf club heads (e.g., drivers, irons, putters, etc.) to be inserted and removed from the configurable golfing apparatus. The golf club shaft inside the rectangular handle portions complies with straightness, bending and flexibility, and twisting and torque, properties and attachment to a golf club head requirements for a golf club shaft required by the United States Golf Association (USGA) and Royal and Ancient (R&A) Golf Club of St Andrews rules and functions in a manner similar to a golf club shaft not enclosed in a rectangular handle portion.

23 Claims, 14 Drawing Sheets

(51) Int. Cl.

| | |
|---|---|
| ***A63B 60/16*** | (2015.01) |
| ***A63B 53/02*** | (2015.01) |
| ***A63B 71/06*** | (2006.01) |
| ***A63B 24/00*** | (2006.01) |

(52) U.S. Cl.
CPC ..... *A63B 60/08* (2015.10); *A63B 60/16* (2015.10); *A63B 71/0622* (2013.01); *A63B 71/0686* (2013.01); *A63B 2071/0625* (2013.01); *A63B 2209/02* (2013.01); *A63B 2209/08* (2013.01); *A63B 2220/40* (2013.01); *A63B 2220/833* (2013.01); *A63B 2225/20* (2013.01); *A63B 2225/50* (2013.01); *A63B 2225/687* (2013.01); *A63B 2225/74* (2020.08)

(58) Field of Classification Search
CPC ..... A63B 71/0686; A63B 2071/0625; A63B 2209/02; A63B 2209/08; A63B 2220/40; A63B 2220/833; A63B 2225/20; A63B 2225/50; A63B 2225/687; A63B 2225/74; A63B 2071/0694; A63B 2102/14; A63B 2102/18; A63B 2102/22; A63B 53/10; A63B 2102/24; A63B 2102/32; A63B 2209/00
See application file for complete search history.

(56) References Cited

U.S. PATENT DOCUMENTS

| | | | | |
|---|---|---|---|---|
| 4,595,204 | A | 6/1986 | Patterson | |
| 5,152,524 | A | 10/1992 | Brown | |
| 5,152,533 | A | 10/1992 | Radakovich | |
| 5,188,243 | A | 2/1993 | Ruiz | |
| 5,203,390 | A | 4/1993 | Eckstein | |
| 5,520,389 | A | 5/1996 | Furrow | |
| 6,217,042 | B1 | 4/2001 | Kurtz et al. | |
| 6,407,668 | B1 | 6/2002 | Beham | |
| 6,994,633 | B2 | 2/2006 | Czaja et al. | |
| 7,186,189 | B2 | 3/2007 | Huang | |
| 7,544,135 | B1 | 6/2009 | Higgins | |
| 8,463,765 | B2 | 6/2013 | Lesavich | |
| 8,574,091 | B2 | 11/2013 | Cameron | |
| 9,037,564 | B2 | 5/2015 | Lesavich et al. | |
| 9,137,250 | B2 | 9/2015 | Lesavich et al. | |
| 9,361,479 | B2 | 6/2016 | Lesavich et al. | |
| 9,403,073 | B2 * | 8/2016 | McDonnell | A63B 53/14 |
| 9,409,071 | B1 | 8/2016 | Beno et al. | |
| 9,452,333 | B1 | 9/2016 | Chalifoux | |
| 9,569,771 | B2 | 2/2017 | Lesavich et al. | |
| 9,586,114 | B1 | 3/2017 | Chalifoux | |
| 9,700,772 | B2 | 7/2017 | Goldfader | |
| 9,821,205 | B2 | 11/2017 | Chalifoux | |
| 9,968,826 | B2 | 5/2018 | McDonnell et al. | |
| 9,968,827 | B2 | 5/2018 | Beno et al. | |
| 10,046,213 | B2 | 8/2018 | Goldfader | |
| 10,293,235 | B2 | 5/2019 | Beno et al. | |
| 10,473,264 | B1 | 11/2019 | Bedwell | |
| 10,716,981 | B1 | 7/2020 | Biafore, Jr. | |
| 11,291,896 | B1 * | 4/2022 | Cox | A63B 69/0002 |
| 2010/0261537 | A1 * | 10/2010 | Cho | A63B 69/3632 473/238 |
| 2011/0208710 | A1 | 8/2011 | Lesavich | |
| 2012/0064986 | A1 | 3/2012 | Brooks | |
| 2012/0278622 | A1 | 11/2012 | Lesavich et al. | |
| 2014/0189792 | A1 | 7/2014 | Lesavich et al. | |
| 2014/0312056 | A1 | 10/2014 | Jacquelot | |
| 2015/0265890 | A1 | 9/2015 | Presse | |
| 2015/0379301 | A1 | 12/2015 | Lesavich et al. | |
| 2016/0321654 | A1 | 11/2016 | Lesavich et al. | |
| 2020/0139206 | A1 * | 5/2020 | Thaon d'Arnoldi | A63B 53/005 |
| 2020/0289906 | A1 * | 9/2020 | Youk | F21V 33/008 |

OTHER PUBLICATIONS

Equipment Rules: R&A Limited and the United States Golf Association (USGA), 100 pp.

* cited by examiner

CONFIGURABLE GOLFING APPARATUS

CROSS REFERENCES TO RELATED APPLICATION

This U.S. utility patent application claims priority from U.S. Provisional patent application No. 63/077,810, filed Sep. 14, 2020, the contents of which are incorporated by reference.

FIELD OF INVENTION

This application relates to golf clubs. More specifically, it relates to a configurable golfing apparatus for professional and non-professional use.

BACKGROUND OF THE INVENTION

There are many types of golf club handles. Most are circular or oval in shape and are attached directly to a golf club shaft. There are many different types of hand placements used to grip a golf club with a circular or oval shaped golf club handle. The hand placements are different for golfers who are left handed and right handed. The hand placements are also different for different clubs (e.g., driver, iron, putter, etc.) and for different shots on the golf course.

Golf club handles with a circular or oval shape have limitations for the number of different hand placements that can be used to grip the golf club handle.

In addition, golf club handles used for non-professional golfers typically do not include additional components that can be added to the golf club handle to use the golf club handle as a training tool and/or to use the golf club handle as an instrument to increase an amount of fun obtained from playing a round of golf.

Thus, it is desirable to solve some of the problems associated with gripping and using golf handles with circular, oval or other shapes.

SUMMARY OF THE INVENTION

In accordance with preferred embodiments of the present invention, some of the problems associated with golf club handles are overcome. A configurable golfing apparatus is presented.

The configurable golfing, apparatus includes, but is not limited to, a golf club handle that is rectangular in shape with rounded corners. The rectangular golf club handle includes a golf club shaft that is securely mounted within the rectangular golf club handle. The rectangular shape provides new and additional hand placement and new and additional gripping configurations for both right handed and left handed golfers. The configurable golf apparatus allows different golf club heads (e.g., drivers, irons, putters, etc.) to be dynamically inserted and removed from the configurable golf club handle. The golf club shaft inside the rectangular golf club handle complies with straightness, bending and flexibility, and twisting and torque, properties and attachment to a golf club head requirements for a golf club shaft required by the United States Golf Association (USGA). The rectangular golf club handle complies with the cross sectional dimensions, axis of a grip and two grip requirements for a golf club grip required by the USGA. The configurable golfing apparatus meets the requirements for use by professional golfers by USGA and Royal and Ancient (R&A) Golf Club of St Andrews rules. In addition, for non-professional golfers, the configurable golfing apparatus includes additional components (e.g., lighting, audio, accelerometer, etc.) to use the configurable golfing apparatus as a training tool and/or to use the golf club handle as an instrument to increase an amount of fun obtained from playing a round of golf that are not currently allowed by the USGA.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF PREFERRED EMBODIMENTS

Exemplary Configurable Golfing Apparatus

Figure 1:
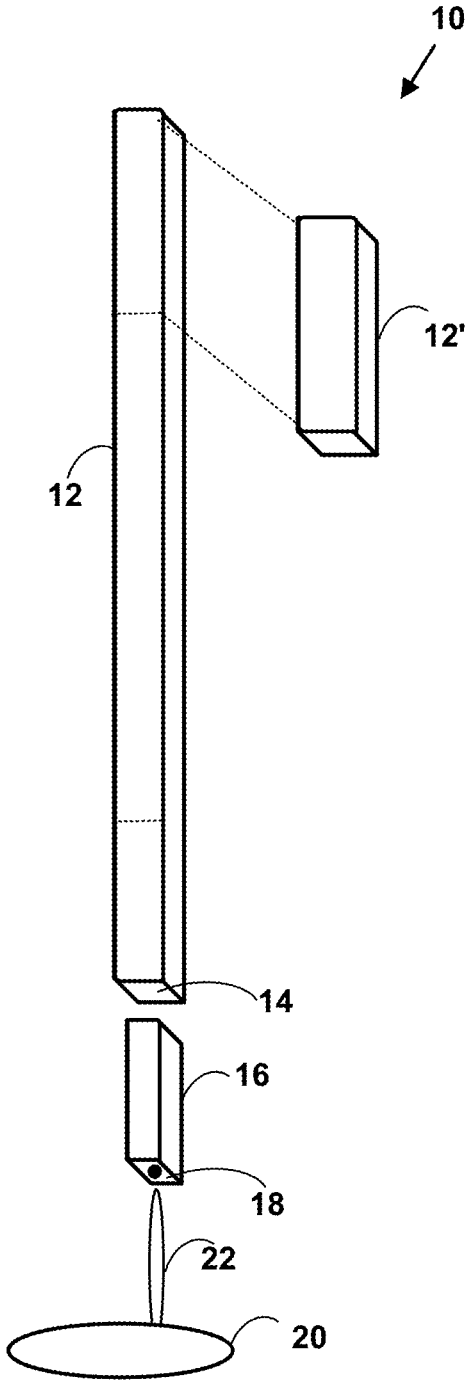
FIG. 1 is a block diagram illustrating an exemplary configurable golfing apparatus.

FIG. 1 is a block diagram 10 illustrating an exemplary configurable golfing apparatus 12.

This exemplary configurable golfing apparatus 12 includes a rectangular shape with rounded corners. The four sides of the rectangle each include a flat surface. In one embodiment, the exemplary configurable golfing apparatus 12, includes a solid component with a hollow receptacle 14 at a first end to accept a golf club head connection component 16. In another embodiment, the exemplary configurable golfing apparatus 12 includes a hollow component. In such an embodiment, the exemplary configurable golfing apparatus 12 includes hollow receptacle components 14 at both ends of the exemplary configurable golfing apparatus 12. In another embodiment, a first portion of the exemplary configurable golfing apparatus 12 is hollow and a second portion of the golf club shaft is solid. However, the present invention is not limited to such embodiments and other embodiments can be used to practice the invention.

In another embodiment, the exemplary configurable golfing apparatus 12, further includes a gripping portion 12' of a pre-determined length of about 6 inches (about 15.24 centimeters) that is slightly larger in size than the rest of the golf club shaft 12. In addition, this additional portion 12' may further include its surfaces covered by a gripping material (e.g., rubber, plastic, etc.) to allow for more secure and/or comfortable gripping. However, the present invention is not limited to such embodiments and other embodiments can be used to practice the invention.

The exemplary configurable golfing apparatus 12 further includes a golf club head connection component 16. The golf club head connection component 16 is insertable and removable from the hollow receptacle 14 at the first end of exemplary configurable golfing apparatus 12. The golf club head connection component 16 includes a first end with a club head hollow receptacle socket 18 for accepting a golf club head 20. The golf club head connection component 16 includes a first end with a universal club head hollow receptacle socket 18 for accepting a golf club head 20 from any golf club manufacturer. However, the present invention is not limited to this embodiment and other embodiments can be used to practice the invention. Additional embodiments of the golf club head connection component 16 are described with respect to FIG. 5, herein.

In one embodiment, the hollow receptacle 18 socket is lined with a rubber and/or plastic and/or other material to keep the golf club head 20 in place with a friction mounting force. However, the present invention is not limited to this embodiment and other embodiments can be used to practice the invention. Additional embodiments of the golf club head connection component 16 are described with respect to FIG. 5, herein.

The golf club head 20 includes, but is not limited to, putter heads, iron heads and driver heads. However, the present invention is not limited to golf club heads and other golf related components can also be used to practice the invention such as golf ball retriever, umbrella, and/or other golf related components. In one embodiment, the first end with the club head hollow receptacle socket 18 of the golf club head connection component 16 includes a circular, oval, square, rectangle and/or other polygon shape for accepting a shaft component 22 of the golf club head 20. FIG. 1, illustrates the club head hollow receptacle socket 18 of the golf club head connection component 16 as a rectangular shape only for simplicity. However the present invention is not limited to these embodiments, and other embodiments can be used to practice the invention.

The golf club head connection component 14 is specifically sized and shaped to be easily insertable and removable from a lower end of the exemplary configurable golfing apparatus 12 and provide stability for connecting a golf club head 20 and stability when the golf club 20 is used to strike a golf ball. In one embodiment, the golf club head connection component 14 is a solid component with the first end including the hollow socket receptacle 18 for accepting shaft component 22 of the golf club head 20. In another embodiment, the golf club head connection component 14 is a hollow component including a small solid portion (e.g., about 1 inch size component, about 2.54 centimeters (cm)) at the first end including the hollow receptacle 16 for accepting shaft component 22 of the golf club head 20. However the present invention is not limited to these embodiments, and other embodiments can be used to practice the invention.

Figure 2:
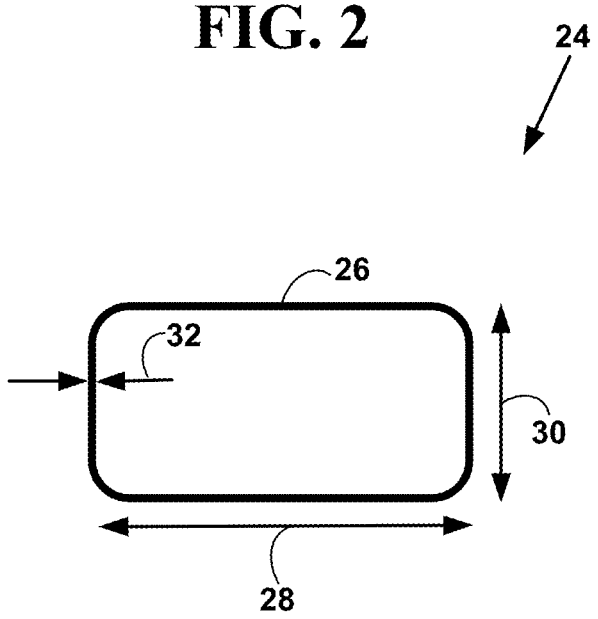
FIG. 2 is a cross section view of the exemplary configurable golfing apparatus.

FIG. 2 is a block diagram 24 of a cross section view 26 of the exemplary configurable golfing apparatus 12.

In an exemplary embodiment exemplary configurable golfing apparatus 12 includes a rectangular shape with rounded corners. In one exemplary embodiment, the exemplary configurable golfing apparatus 12 includes a width 28 of about one inch (about 2.54 cm) a height 30 of about three-quarters of an inch (about 1.91 cm) and a thickness 32 of about one-sixth inches (about 0.16 cm) to about one-quarter inches (about 0.635 cm). In one embodiment, the thickness 32 of the exemplary configurable golfing apparatus 12 may vary in thickness for selected sides. For example, the thickness of the two sides comprising width 28 may be thicker than the two sides comprising the height 30, and vice-versa. In other embodiment, the thickness 32 of the exemplary configurable golfing apparatus 12 may vary in thickness for one to all selected sides. However, the present invention is not limited to this embodiment and other embodiments with other sizes for the width, height and thickness can be used to practice the invention.

It has been determined experimentally, that the exemplary configurable golfing apparatus 12 with a rectangular shape with rounded corners and with a width-to-height ratio of about 1 to 0.75 is an optimal size for both gripping and providing the bendability and twistability characteristics required for a golf shaft by the United States Golf Association (USGA).

However, the present invention is not limited to this embodiment and other embodiments with other sizes for the width and height can be used to practice the invention.

In this exemplary embodiment, the exemplary configurable golfing apparatus 12 includes a rectangular shape with four flat services with rounded corners and includes a specific size and shape to allow optimal gripping with multiple different types of grips for both right handed and left handed golfers. The rounded corners also prevent snagging the exemplary configurable golfing apparatus 12 on surfaces of other objects and prevent fatigue of hands of a golfer. However, the present invention is not limited to this embodiment and other embodiments can be used to practice the invention.

In another embodiment, the exemplary configurable golfing apparatus 12 includes a rectangular shape with square corners. However, the present invention is not limited to this embodiment and other embodiments with other sizes for the width and height can be used to practice the invention.

In another embodiment, the exemplary configurable golfing apparatus 12 includes a square shape, triangular shape, circular shape, oval shape, and/or other polygonal shape. However, the present invention is not limited to this embodiment and other embodiments can be used to practice the invention.

In another embodiment, the exemplary configurable golfing apparatus 12 is produced with pre-determined dimensions smaller than those illustrated in FIG. 2 to allow the exemplary configurable golfing apparatus 12 to be used by teen and child golfers whose hands are smaller than adult golfers. For example a width 28 of three-quarters of an inch (about 1.91 cm) a height 30 of about one-half of an inch (about 0.127 cm). However, the present invention is not limited to this embodiment and other embodiments with other sizes for the width, height and thickness can be used to practice the invention.

The exemplary configurable golfing apparatus 12, 12', 12", 100 is manufactured as a hollow or solid component to comply with United States Golf Association (USGA) rules for golf club shafts: (1) The shaft must be straight: "The shaft of the club must be straight from the top of the grip to a point not more than five inches (127 millimeters (mm)) above the sole, measured from the point where the shaft ceases to be straight along the axis of the bent part of the shaft and/or socket."

(2) bendability and twistability of the shaft: "At any point along its length, the shaft must bend in such a way that the deflection is the same regardless of how the shaft is rotated about its longitudinal axis; and twist the same amount in both directions;" and (3) How the shaft is attached: "The shaft must be attached to the club head at the heel directly or through a single plain neck and/or socket. The length from the top of the neck and/or socket to the sole of the club must not exceed five inches (127 mm), measured along the axis of, and following any bend in, the neck and/or socket."

Figure 3:
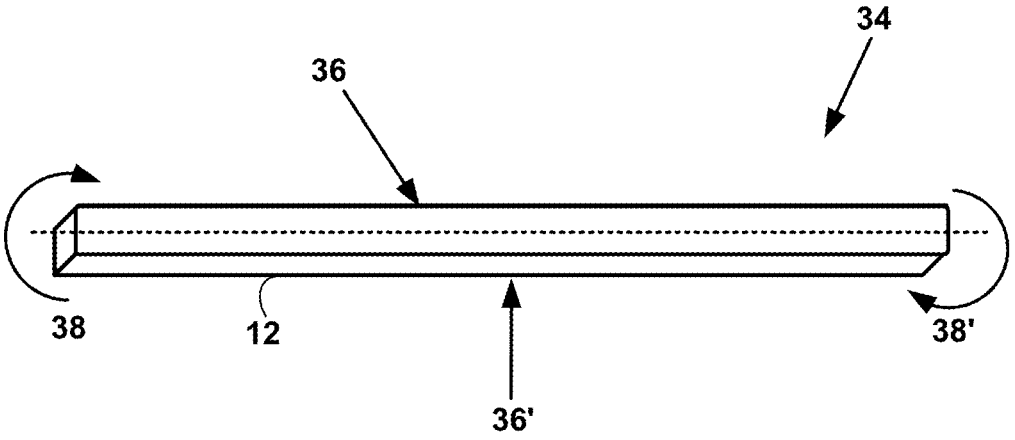
FIG. 3 is a block diagram illustrating a side view of the exemplary configurable golfing apparatus.

FIG. 3 is a block diagram 34 illustrating a side view of the exemplary configurable golfing apparatus 12. The exemplary configurable golfing apparatus 12, 12' 12" bends in such a way that the deflection 36, 36 is the same regardless of how the shaft is rotated about its longitudinal axis and twists the same amount in both directions 38, 38'. In another embodiment, the exemplary configurable golfing apparatus 12, 12' 12" bends in such a way that the deflection 36, 36 is different when the shaft is rotated about its longitudinal axis and twists in different amounts in both directions 38, 38'. However, the present invention is not limited to such embodiments and other embodiments can be used to practice the invention.

In one embodiment, the exemplary configurable golfing apparatus 12, 12', 12" and the golf club head connection component 14 are manufactured from wood, metal, rubber, plastic, composite materials, graphene, graphite, fiberglass, carbon fiber and/other types of materials and/or various combinations thereof.

In one embodiment, the plastics include, but are limited to, Polyetherimide, Polyimide other thermosetting polyimides, and/or types of plastics. However, the present invention is not limited to these materials and other materials can be used to practice the invention.

"Polyetherimide" (PEI) is an amorphous, amber-to-transparent thermoplastic with characteristics similar to the related plastic PEEK. Polyether ether ketone (PEEK) is a colorless organic polymer thermoplastic Relative to PEEK, PEI is cheaper, but less temperature-resistant and lower in impact strength.

For example, commercially, ULTEM is a family of PEI products manufactured by SABIC. ULTEM resins are often used due to their heat resistance, solvent resistance and flame resistance.

"Polyimide" (PI) is a polymer of imide monomers. Such imide monomers include pyromellitic dianhydride and 4,4'-oxydianiline and others. Polyimide materials are lightweight, flexible, resistant to heat and chemicals. Polyimide parts are not affected by commonly used solvents and oils, including hydrocarbons, esters, ethers, alcohols and freons. They also resist weak acids.

"Thermosetting polyimides" are known for thermal stability, good chemical resistance, excellent mechanical properties. Normal operating temperatures for such polymides range from cryogenic with temperatures below about −238° F. (−150° C.) to those exceeding about 500° F. (260° C.). However, the present invention is not limited to these materials and other materials can be used to practice the invention.

In one embodiment, one embodiment, the exemplary configurable golfing apparatus 12, 12', 12" and the golf club head connection component 14 are created from thermally conductive elastomers are used. Thermally conductive elastomers exhibit thermal conductivity in a flexible, compliant and soft touch material. Conventional elastomers are thermal insulators. The rmal conductivity of thermally conductive elastomers range from 1.0 W/mK to 15 W/mK. This exceptional level of thermal conductivity in an elastomer is about five to 75 times the value of conventional elastomer plastics. The optimal level of thermal conductivity for any application depends on the input (e.g., heat, etc.) size of the device and convection conditions.

Thermally conductive elastomers are thermoplastics that can be molded to 3-dimensional net shape objects using conventional injection molding equipment. Thermally conductive elastomers are typically characterized by their hardness or Shore durometer thermally conductive elastomers range in hardness from "Shore A 40" (e.g., similar to a soft eraser, etc.) to "Shore D 80" (e.g., similar to a bowling ball, etc.). Thermally conductive elastomers are used to transfer heat and therefore must withstand the application temperature thermally conductive elastomers have been used in applications up to 356° F. (180° C.). Thermally Conductive elastomers maintain the corrosion resistance of plastic and include the advantage of increased heat transfer rate.

The present invention is also not limited to the rmally conductive elastomers embodiment described and more, fewer or other types of plastics and/or thermally conductive elastomers can be used to practice the invention.

A "composite material" is a combination of two materials with different physical and chemical properties. The different physical or chemical properties of the two materials remain separate and distinct at the macroscopic or microscopic scale within the finished structure. Common polymer-based composite materials, include at least two parts, a substrate (e.g., fibers, etc.) and a resin.

When they are combined they create a material which is specialized material to do a certain job, for instance to become stronger, lighter or resistant to electricity. Composite materials also improve strength and stiffness of the materials. One reason for their use over traditional materials is because they improve the properties of their base materials and are applicable in many situations including for creating gulf club shafts The composite materials include, but are not limited to, "Fiber-reinforced polymers" (FRP) including thermoplastic composites, short fiber thermoplastics, long fiber thermoplastics or long fiber-reinforced thermoplastics. There are numerous thermoset composites, but advanced systems usually incorporate aramid fiber and carbon fiber in an epoxy resin matrix. The composite materials also include carbon/carbon composite materials with carbon fibers and a silicon carbide matrix.

"Carbon fibers" are fibers about 0.00020-0.000:39 inches (about 5 to 10 micrometers) in diameter and composed mostly of carbon atoms. Carbon fibers have several advantages including high stiffness, high tensile strength, low weight, high chemical resistance, high temperature tolerance and low thermal expansion.

"Graphene" is an allotrope of carbon consisting of a single layer of atoms arranged in two-dimensional honeycomb lattice. The name is a portmanteau of "graphite" and the suffix "-ene," reflecting the fact that the graphite allotrope of carbon consists of stacked graphene layers.

"Natural graphite" is a crystalline form of the element carbon with its atoms arranged in a hexagonal structure. It occurs naturally in this form and is the most stable form of carbon under standard conditions.

"Synthetic graphite" is a man-made material that is extremely resistant to high temperatures and acidic or basic solutions. Graphite can be engineered to obtain specific properties such as density, electrical resistance, hardness, porosity, compressive strength, flexural strength, coefficient of thermal expansion and thermal conductivity.

In one embodiment, the exemplary configurable golfing apparatus 12, 12', 12" are graphite and are much lighter in comparison to metal golf club shafts. As a result, lightweight graphite golf club shafts can help to create a greater swing velocity for generating more power.

"Fiberglass" is a common type of fiber-reinforced plastic using glass fiber. The fibers may be randomly arranged, flattened into a sheet (called a chopped strand mat), or woven into a fabric. The plastic matrix may be a thermoset polymer matrix—most often based on thermosetting polymers such as epoxy, polyester resin, or vinylester—or a thermoplastic.

Cheaper and more flexible than carbon fiber, fiberglass is stronger than many metals by weight, is non-magnetic, non-conductive, transparent to electromagnetic radiation, can be molded into complex shapes, and is chemically inert under many circumstances.

The whole exemplary configurable golfing apparatus 12, 12', 12" and the golf club head connection component 14 and/or separate components and combinations therof are injection molded, extruded, pultruded, pull-winded, 3D-printed and/or manufactured and/or produced with other techniques using one or more the materials described herein. However, the present invention is not limited to such an embodiment and more, fewer or other types manufacturing techniques can be used to practice the invention.

"Injection molding" is a manufacturing process for producing parts by injecting molten material into a mold. Injection molding can be performed with a host of materials mainly including metals (for which the process is called die-casting), glasses, elastomers, confections and most commonly thermoplastic and thermosetting polymers.

Material for an injection molded part is fed into a heated barrel, mixed (e.g., using a helical shaped screw, etc.), and injected into a mold cavity, where it cools and hardens to the configuration of the cavity. After a product is designed, usually by an industrial designer or an engineer, molds are made by a mold-maker (or toolmaker) from metal, usually either steel or aluminum, and precision machined to form the features of the desired part. Injection molding is widely used for manufacturing a variety of parts, from the smallest components to entire body panels of cars. Advances in 3D printing technology, using photopolymers that do not melt during the injection molding of some lower temperature thermoplastics, can be used for some simple injection molds.

"Extrusion" is a manufacturing process where a material is pushed and/or drawn through a die to create long objects of a fixed cross-section. Hollow sections are usually extruded by placing a pin or mandrel in the die. Extrusion may be continuous (e.g., producing indefinitely long materials, etc.) or semi-continuous (e.g., repeatedly producing many shorter pieces). Some extruded materials are hot drawn and others may be cold drawn.

The feedstock may be forced through the die by various methods: by an auger, which can be single or twin screw, powered by an electric motor; by a ram, driven by hydraulic pressure, oil pressure or in other specialized processes such as rollers inside a perforated drum for the production of many simultaneous streams of material.

In one embodiment, the exemplary configurable golfing apparatus 12, 12', 12" and/or golf club head connection component 14 comprise extruded plastic materials including, but not limited to, Polyvinyl Chloride (PVC), Acrylonitrile Butadiene Styrene (ABS), High Impact Polypropylene (HIP), Polypropylene, High-Density Polyethylene (HDPE), Polycarbonate, Polyethylene Terephthalate Glycol (PETG), Nylon, Fiber reinforced Polypropylene, Fiber Reinforced Plystyrene and other types of plastics. In another embodiment, the exemplary golf club shaft 12 and/or golf club head connection component 14 comprise composite materials. In another embodiment, the exemplary configurable golfing apparatus 12 golf club head connection component 14 comprise recycled plastic materials. However, the present invention is not limited to such embodiments and other embodiments can also be used to practice the invention.

Plastic extrusion commonly uses plastic chips, which are heated and extruded in the liquid state, then cooled and solidified as it passes through the die. In some cases (such as fiber reinforced tubes) the extrudate is pulled through a very long die, in a process called "pultrusion." However, the present invention is not limited to such embodiments and other embodiments can also be used to practice the invention.

"Pultrusion" is a manufacturing process for producing continuous lengths of materials. Pultrusion raw materials include a liquid resin mixture (e.g., containing resin, fillers and specialized additives) and reinforcing fibers (e.g., fiberglass, composite materials, etc.). The process involves pulling these raw materials (rather than pushing as is the case in extrusion) through a heated steel forming die using a continuous pulling device. The reinforcement materials are in continuous forms such as rolls of fiberglass mat or doffs of fiberglass roving. As the reinforcements are saturated with the resin mixture in the resin impregnator and pulled through the die, the gelation (or hardening) of the resin is initiated by the heat from the die and a rigid, cured profile is formed that corresponds to the shape of the die.

Protruded laminates are also used. Most pultruded laminates are formed using rovings aligned down the major axis of the part. Various continuous strand mats, fabrics (e.g., braided, woven and knitted), and texturized or bulked rovings are used to obtain strength in the cross axis or transverse direction. However, the present invention is not limited to such embodiments and other embodiments can also be used to practice the invention.

The pultrusion process is normally continuous and highly automated. Reinforcement materials, such as roving, mat or fabrics, are positioned in a specific location using preforming shapers or guides to form a pultruson. The reinforcements are drawn through a resin bath where the material is thoroughly coated or impregnated with a liquid thermosetting resin. The resin-saturated reinforcements enter a heated metal pultrusion die. The dimensions and shape of the die define the finished part being fabricated. Inside the metal die, heat is transferred initiated by precise temperature control to the reinforcements and liquid resin. The heat energy activates the curing or polymerization of thermoset resin changing it from a liquid to a solid. The solid laminate emerges from the pultrusion die to the exact shape of the die cavity. The laminate solidifies when cooled and it is continuously pulled through the pultrusion machine and cut to the desired length. The process is driven by a system of caterpillar or tandem pullers located between the die exit and the cut-off mechanism.

In one embodiment, the pultrusion resins include bisphenol-a epichlorohydrin-based vinyl esters. In another embodiment, the resins include polyesters including isophthalic, orthophthalic, propylene-maleate, fire resistant, and high cross-link density. However, the present invention is not limited to these resins and other resins can be used to practice the invention.

In one embodiment, the pultrusions include re-enforcing fibers comprising, fiberglass fibers, composite fibers, etc. However, the present invention is not limited to these resins and other resins can be used to practice the invention.

One resin used in fiberglass pultrusions is a thermoset resin. The resin used in Polyvinyl Chloride (PVC) pultrusions are typical thermoplastic resins. In the pultrusion process, under heat and pressure, the rmoset resins and re-enforcing fibers form a new inert material that is impervious to temperature. Pultruded fiberglass physical properties do not change through the full temperature cycle up to temperatures of about 200 degrees Fahrenheit (° F.). In direct contrast, PVC resins typically become unstable at temperatures greater than 155° F. However, the present invention is not limited to such embodiments and other embodiments can also be used to practice the invention.

Pultrusions, include but are not limited to, structures comprising: (1) HIGH STRENGTH—typically stronger than structural steel on a pound-for-pound basis; (2) LIGHTWEIGHT—Pultrusions are 20-25% the weight of steel and 70% the weight of aluminum. Pultruded products are easily transported, handled and lifted into place; (3) CORROSION/ROT RESISTANT—Pultruded products will not rot and are impervious to a broad range of corrosive elements; (4) NON-CONDUCTIVE—fiberglass reinforced pultrusions have low thermal conductivity and are electrically non-conductive; (5) ELECTRO-MAGNETIC TRANSPARENT—Pultruded products are transparent to radio waves, microwaves and other electromagnetic frequencies; (6) DIMENSIONAL STABLE—The coefficient of thermal expansion of pultruded products is slightly less than steel and significantly less than aluminum; (7) LOW TEMPERATURE CAPABLE—FiberGlass fiber reinforced pultrusions exhibit excellent mechanical properties at very low temperatures, even −70° F. Tensile strength and impact strengths are greater at −70° F. than at +80° F.; (8) AESTHETICLY PLEASING—Pultruded components are pigmented throughout the thickness of the part and can be made to virtually any desired custom color. Special surfacing veils are also available to create special surface appearances such as wood grain, marble, granite, etc.; and (9) COST EFFICTIVE—pultruded products are typically cheaper than those made of metals, wood, etc. and other materials. However, the present invention is not limited to such embodiments and other embodiments can also be used to practice the invention.

A "3D printer" includes 3D printing or "Additive manufacturing." 3D printing is a process of making a three-dimensional solid object of virtually any shape from a digital model. 3D printing is achieved using an "additive process," where successive layers of material (e.g., plastics, composite materials, etc.) are laid down in different shapes. 3D printing is also considered distinct from traditional machining techniques, which mostly rely on the removal of material by methods such as cutting or drilling and are "subtractive" processes.

In one embodiment, the plural protruding components and plural intruding components include additional fiberglass, plastic, ester, polyester, nylon, composite materials or other types of filaments or webbing to add additional strength to the pultruded exemplary configurable golfing apparatus 12, 12', 12" and/or golf club head connection component 14. The filaments or webbing are applied internally or externally to the pultruded exemplary configurable golfing apparatus 12, 12', 12" and/or golf club head connection component 14. However, the present invention is not limited to such embodiments and other embodiments can also be used to practice the invention.

In one embodiment, and extruded structure and/or plutruded exemplary configurable golfing apparatus 12, 12', 12" and/or golf club head connection component 14 are produced with an overwrapping transverse winding process called "pullwinding." The pullwinding process combines continuous filament winding with a pultrusion manufacturing process to produce a pultruded pullwound hollow and/or solid rectangular structure for exemplary configurable golfing apparatus 12, 12', 12".

This "pullwinding" process incorporates plural longitudinal reinforcement fibers with plural helical-wound (e.g., hoop, etc.) layers, providing maximum torsional properties and hoop strength. A self-contained inline winding unit is used with a pultrusion machine for feeding angled fibers between layers of unidirectional fibers before curing in a pultrusion die. The plural longitudinal re-enforcement fibers are used for axial and bending resistance while the plural helical-wound fibers are used for hoop tension and compression resistance. The pullwinding equipment is comprised of twin winding heads which revolve in opposite directions over a spindle. However, the present invention is not limited to such an embodiment and other embodiments can also be used to practice the invention. The present invention can be practiced without the pullwound components.

In one embodiment, the exemplary configurable golfing apparatus 12, 12', 12" is constructed from one or more materials that float when the exemplary golf club shaft 12, 12', 12" is placed and/or thrown into a body of water.

Figure 4:
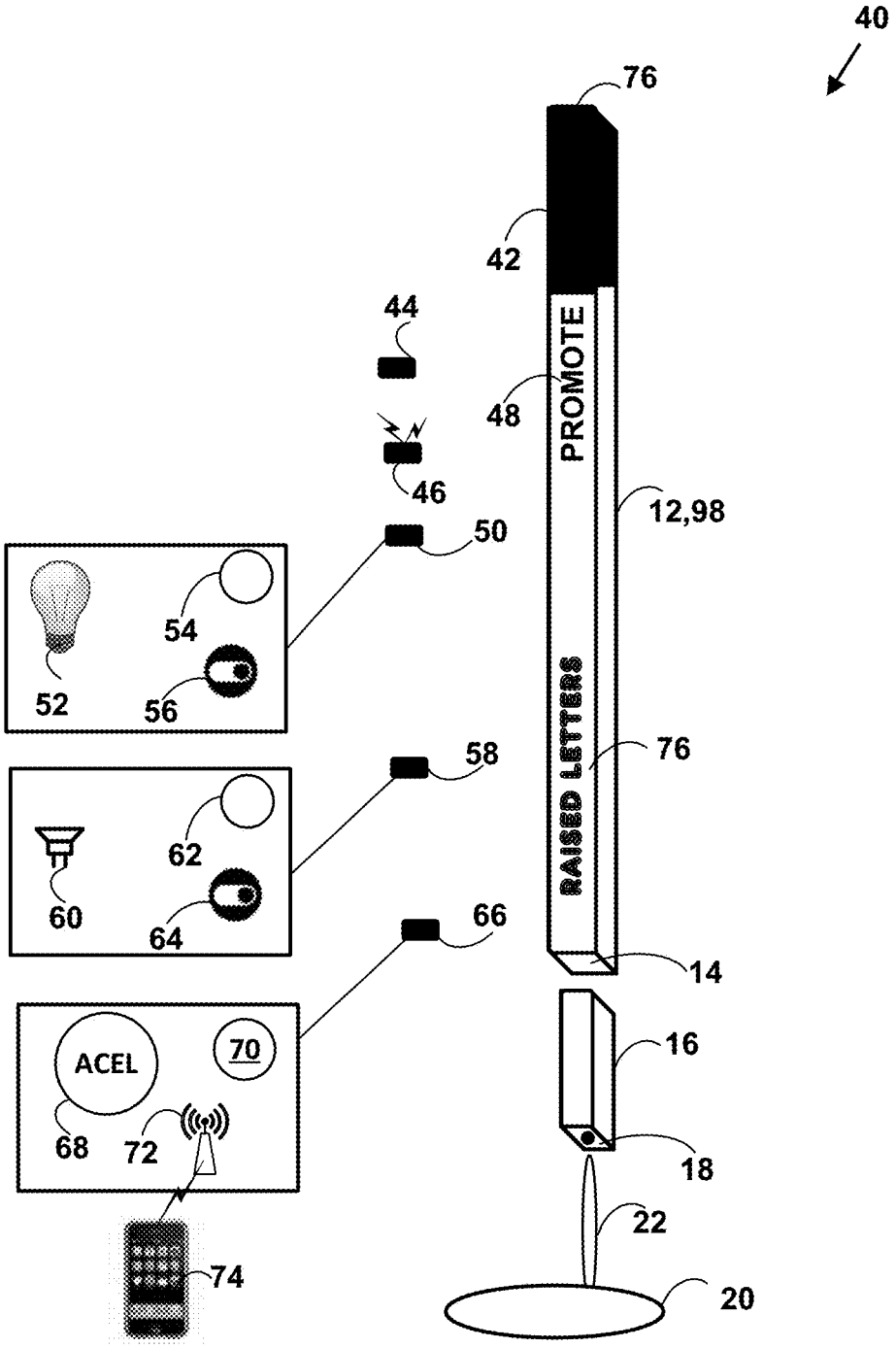
FIG. 4 is a block diagram illustrating exemplary additional components of the exemplary configurable golfing apparatus.

FIG. 4 is a block diagram 40 illustrating exemplary components of the exemplary configurable golfing apparatus 12.

The exemplary configurable golfing apparatus 12 further includes an additional gripping component 42. The gripping component 42 includes, but is not limited to, rubber, plastic and/or other materials that provide a coating onto the exterior surfaces of the exemplary configurable golfing apparatus 12 for a pre-determined distance down the exemplary configurable golfing apparatus 12. In another embodiment, the gripping component 42, includes, but is not limited to, a gripping component 42 with a pre-determined size and shape designed slide over a top portion end of the exemplary configurable golfing apparatus 12. In such an embodiment, the gripping component 42 is attachable and removable from the exemplary golf club shaft to provide other custom types of gripping components 42. In another embodiment, the gripping component 42 includes an ergonomic gripping component of a same or a different size and shape than the golf club shaft to allowing gripping of the exemplary configurable golfing apparatus 12 most efficiently and safely and to prevent fatigue and/or gripping related injuries. However, the present invention is not limited to these embodiments and other embodiments can be used to practice the invention.

In one embodiment, the exemplary configurable golfing apparatus 12 is a hollow component and further includes one or more weights 44 (e.g., metal, stone, ceramic, etc.) with a pre-determined size and shape (e.g., smaller rectangle with rounded edges, etc.) to easily and securely slide inside the hollow component of the exemplary golf club shaft 12. The one or more metal weights 44 allow a golf club head 20 attached to the exemplary configurable golfing apparatus 12 to strike a golf ball with a greater force.

In one embodiment, exemplary configurable golfing apparatus 12 is a hollow component and further includes one or more magnets 46 fastened inside the hollow component. The one or more magnets 46 allow metal components (e.g., iron, cobalt and nickel, etc.) such as ball markers, golf tee holders, to be temporarily attached to the exterior of the exemplary golf club shaft 12.

In one embodiment, the exemplary configurable golfing apparatus 12 is a hollow component and made from a transparent material. In such an embodiment, advertising and/or other types of promotional materials 46 are inserted into the hollow component to advertise and/or promote goods and/or services on one or more of the four sides of the exemplary configurable golfing apparatus 12. The advertisement and/or promotional materials, also include, but are not limited to, those for professional, college and high-school sports teams, community service initiatives, legal, medical, dental, accounting, real-estate, etc. professionals, etc.

In one embodiment, the exemplary configurable golfing apparatus 12 is a hollow component and made from a transparent material and further includes a lighting component 48 visible on one or more of the four sides of the exemplary configurable golfing apparatus 12. In such an embodiment, the lighting component 48 includes, but is not limited to, small incandescent light bulbs, Light Emitting Diodes (LED) light bulbs 50 and/or other types of lighting components, an on/off switch component 52 and a battery component 54 connected with an electrical circuit. The on/off switch component 52 extends outside one of the surfaces of the exemplary configurable golfing apparatus 12 for use. In such an embodiment, the exemplary configurable golfing apparatus 12 is also used to advertise and/or promote goods and/or services, create interest among golfers and/or spectators and/or be used in low light and/or dark playing conditions.

In one embodiment, the exemplary configurable golfing apparatus 12 is a hollow component further including one or more audio components 58. The one or more audio components, include, but are not limited to, wireless speakers 60 (e.g., Bluetooth, etc.), an on/off switch component 62 and a battery component 64 connected with an electrical circuit. The wireless speakers allow the exemplary golf club shaft 12 to accept and play audio information such as music, weather reports, etc. The on/off switch component 62 extends outside one of the surfaces of the exemplary golf club shaft 12 for use.

In one embodiment, the exemplary configurable golfing apparatus 12 is a hollow component further including in accelerometer component 66.

An "accelerometer" 68 is an electronic sensor that measures the acceleration forces acting on an object, in order to determine the object's position in space and monitor the object's movement. An accelerometer 68 is a tool that measures "proper acceleration." Proper acceleration is the acceleration (i.e., the rate of change of velocity, etc.) of an object in its own instantaneous rest frame. This is different from "coordinate acceleration," which is acceleration in a fixed coordinate system.

Most accelerometers are very small, and they are often referred to as Micro-Electro-Mechanical Systems (MEMS) accelerometers. They are embedded in a myriad of handheld electronic devices (such as smart phones, wearable network devices electronic tablets, video game controllers, etc.), laptop computer, desktop computer, Internet of Things (IoT), network device, etc. In smart phones and electronic tablets, the accelerometer is responsible for "flipping" the screen when the device is rotated.

The accelerometer component 66 is used to measure and record the path of the exemplary configurable golfing apparatus 12 as it is swung, the force by which the exemplary configurable golfing apparatus 12 impacts a golf ball, etc. In one embodiment, the accelerometer component further includes a stroke recording component application 70 counting each time the accelerometer 68 exceeds a pre-determined force including a force when the exemplary configurable golfing apparatus 12 impacts a golf ball. In such embodiments, the exemplary configurable golfing apparatus 12 further includes a wireless component 72 to allows the accelerometer component 66 and the stroke recording component application 70 to send accelerometer data wirelessly to an external network device 74 such as a smart phone, wearable network device (e.g., watches, glasses, fitness watches and activity bracelets, etc.), electronic tablet, etc.

In one embodiment, the exemplary configurable golfing apparatus 12 further includes raised letters 76 and/or raised graphical objects on one or more of its four sides. In such an embodiment, the exemplary configurable golfing apparatus 12 is used to advertise and/or promote goods and/or services. In one embodiment, the exemplary configurable golfing apparatus 12 is manufactured with raised letters 76 on one or more of its four sides.

In one embodiment, the exemplary configurable golfing apparatus 12, includes a solid component with a hollow receptacle 14 at a second end 78 to accept other components, including, but not limited to, a golf ball retriever used if a golf ball is hit into a body of water, an umbrella, a flashlight, beverage holder, and/or any additional useful components.

As illustrated in FIG. 4, additional component embodiments 44, 46, 50, 58, 66 are created with a pre-determined size and shape (e.g., smaller rectangle with rounded or square edges, etc.) to easily and securely slide inside the hollow component of the exemplary configurable golfing apparatus 12.

If the exemplary configurable golfing apparatus 12 is manufactured as a solid component, the additional component embodiments 44, 46, 50, 58, 66 may be embedded as integral components during the manufacturing process and/or not integral and not embedded and/or not used at all.

The additional embodiments 44, 46, 50, 58, 66 will be used for non-professional golfers until the USGA may someday approve such items for inclusion in golf shafts to be use by professional golfers.

However, the present invention is not limited to these embodiments and other embodiments can be used to practice the invention. In addition, the embodiments described herein can be used in various combinations selecting one, two, three, etc. embodiments up to including all the additional components of all the various embodiments described herein.

In one embodiment, the exemplary configurable golfing apparatus 12 further includes manufacturing the exemplary configurable golfing apparatus 12 in one or more different colors on one more sides of exemplary configurable golfing apparatus 12. The one or more different colors make the exemplary configurable golfing apparatus 12 easier to see and locate. The one or more different colors are also used to advertise and/or promote goods and/or services (e.g., sports team colors, university, college, high school colors, company colors, etc.).

In one embodiment, the exemplary configurable golfing apparatus 12 is produced with plural different pre-determined lengths for adult golfers, teen age golfers and child golfers including different physical heights.

Figure 5:
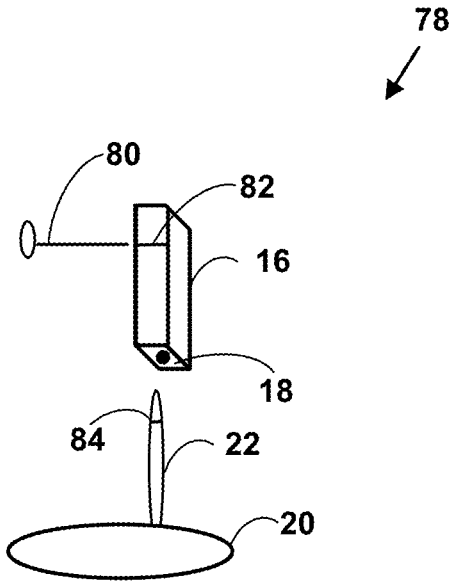
FIG. 5 is a block diagram illustrating embodiments of the golf club head connection component of the exemplary configurable golfing apparatus.

FIG. 5 is a block diagram 78 illustrating embodiments of the golf club head connection component 16 of exemplary configurable golfing apparatus 12.

In one embodiment, the golf club head connection component 16 further includes one or more connection means 80 (e.g., removable/insertable pin, locking pin, rivet, screw, bolt, etc.) for securing the golf club head 20 into the golf club head connection component 16. In such an embodiment, the golf club head connection component 16 further includes one or more horizontal hollow receptacles 82 for accepting the connection means 80 and the golf club head shaft 22 of the golf club head 20 includes one or more horizontal hollow receptacles 84 for accepting the one or more connection means 80. The golf club head shaft 22 of the golf club head 20 is attached to the exemplary configurable golfing apparatus 12 according to USGA rules. However, the present invention is not limited to these embodiments and other embodiments can be used to practice the invention.

Figure 6:
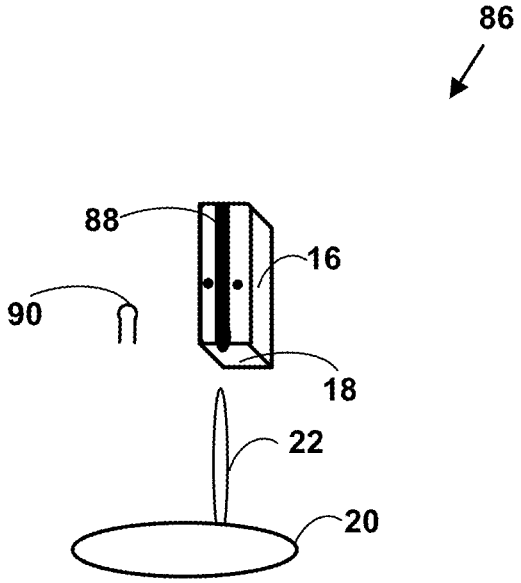
FIG. 6 is a block diagram illustrating embodiments of the golf club head connection component of the exemplary configurable golfing apparatus.

FIG. 6 is a block diagram 86 illustrating embodiments of the golf club head connection component 16 of the exemplary configurable golfing apparatus 12.

In one embodiment, the golf club head connection component 16 further includes a socket with grooved depression receptacle 88 for accepting the golf club head shaft 22 of the golf club head 20. The golf club head shaft 22 of the golf club head 20 is held securely in the socket with grooved depression receptacle 88 with one or more clamping means 90 (e.g. clamps, brackets, etc.). The golf club head shaft 22 of the golf club head 20 is attached to the exemplary configurable golfing apparatus 12 according to USGA and/or R&A rules. However, the present invention is not limited to these embodiments and other embodiments can be used to practice the invention.

In one embodiment, the exemplary configurable golfing apparatus 12, 12', 12" and/or golf club head connection component 14 are manufactured from a same material and/or different materials. In another embodiment, portions of the exemplary configurable golfing apparatus 12, 12', 12" and/or golf club head connection component 14 are manufactured from a same material and/or combinations of different types of materials. However, the present invention is not limited to these embodiments and other embodiments can be used to practice the invention.

Figure 7:
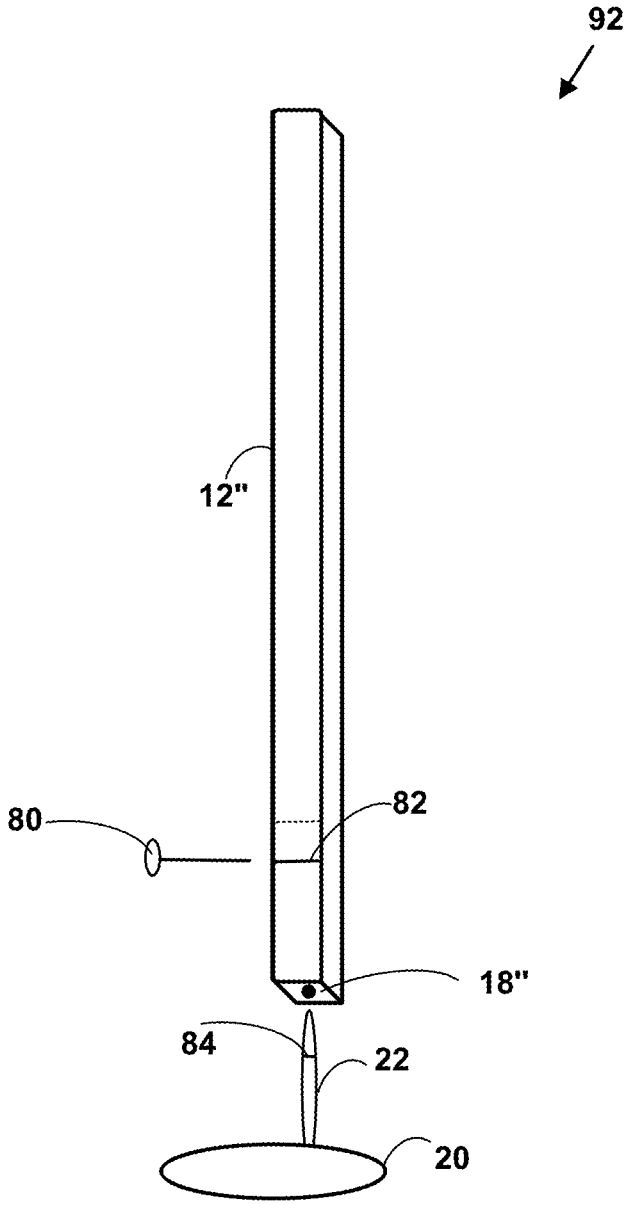
FIG. 7 is a block diagram illustrating embodiments of the golf club head connection component of the exemplary configurable golfing apparatus.

FIG. 7 is a block diagram 92 illustrating embodiments of the exemplary configurable golfing apparatus 12".

In such an exemplary embodiment, the exemplary configurable golfing apparatus 12" is manufactured as a hollow and/or solid component to include an integral golf club head connection component 16 that is permanent part of the exemplary configurable golfing apparatus 12 and is not removable and insertable. In such an embodiment, the golf club head 20 is interchangeable, removable and insertable and is secured into the exemplary configurable golfing apparatus 12" at first end with a golf club shaft socket hollow receptacle 18" for accepting a golf club head shaft 22 from a golf club head 20. The golf club head is held in place with a friction mounting and/or one or more connection means 80, 90, groove mounting 88 with connection means 80, 90 and/or other connection methods. The golf club head shaft 22 of the golf club head 20 is attached to the exemplary configurable golfing apparatus 12" according to USGA rules. However, the present invention is not limited to these embodiments and other embodiments can be used to practice the invention.

Exemplary Configurable Golfing Apparatus with Inserted Golf Shaft

Figure 8:
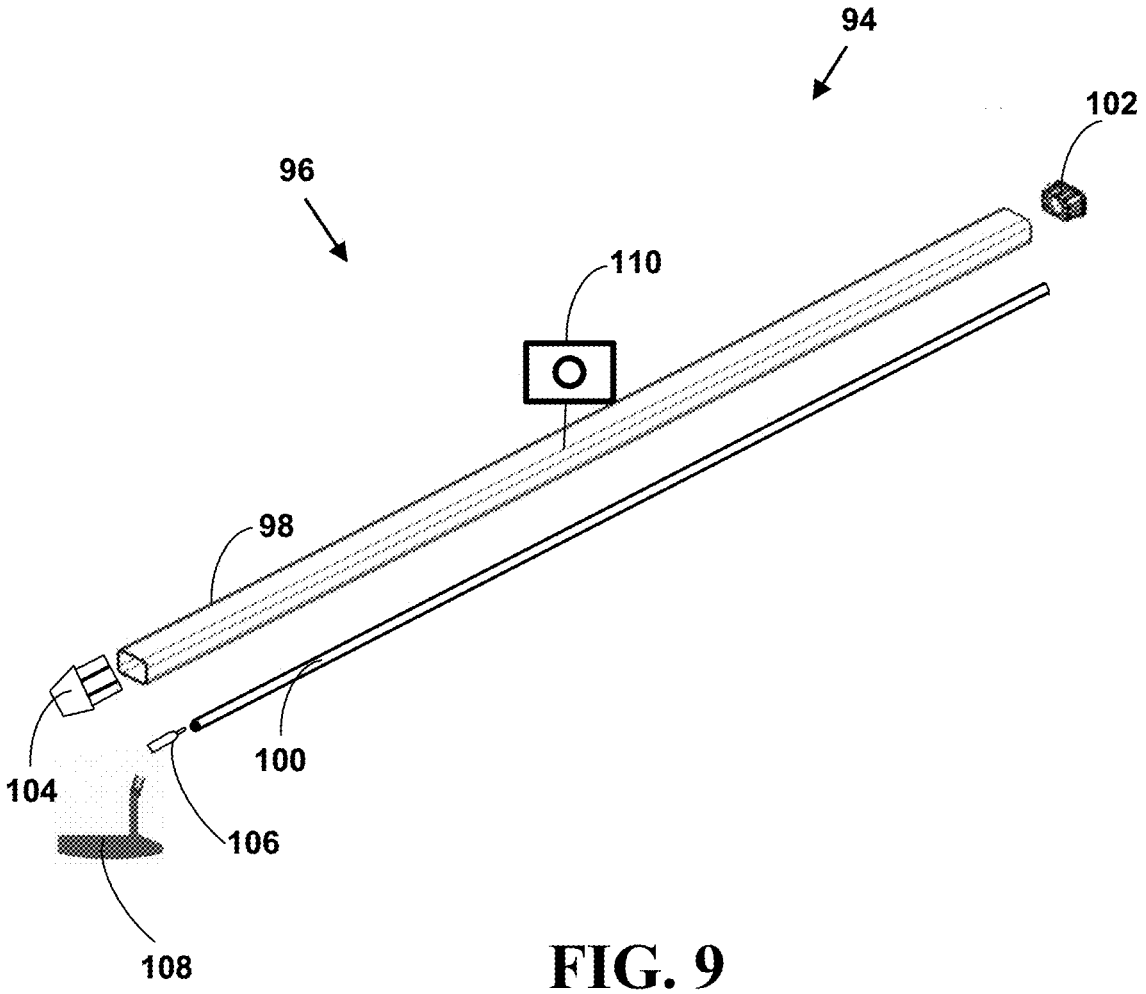
FIG. 8 is a block diagram illustrating a perspective view of an exemplary configurable golfing apparatus.

FIG. 8 is a block diagram 94 illustrating an exemplary configurable golfing apparatus 96.

In FIG. 8, the exemplary configurable golfing apparatus 96, includes but is not limited to, a hollow rectangular gripping portion 98 for enclosing a golf club shaft 100. The golf club shaft 100 is secured and enclosed within the rectangular gripping portion 98. A first golf club shaft holder 102 is included at a first top end of the rectangular gripping portion 98 for engaging and securely holding a first top end of the golf club shaft within the rectangular gripping portion 98. The first golf club shaft holder 102 including a first receptacle for inserting, engaging and securely holding the first top end of the golf club shaft 100. A second golf club shaft holder 104 is included at a second bottom end of the rectangular gripping portion 98 for engaging and securely holding a second bottom end of the golf club shaft 100 within the rectangular gripping portion 98. The second golf club shaft holder 104 including a second receptacle for inserting, engaging and securely holding the second bottom end of the golf club shaft 100. A golf club head connection component 106 is included for inserting and removing one or more different golf club heads 108 into the golf club shaft 100. The golf club head connection component 106 is attached to the second bottom end of the golf club shaft 100.

Figure 9:
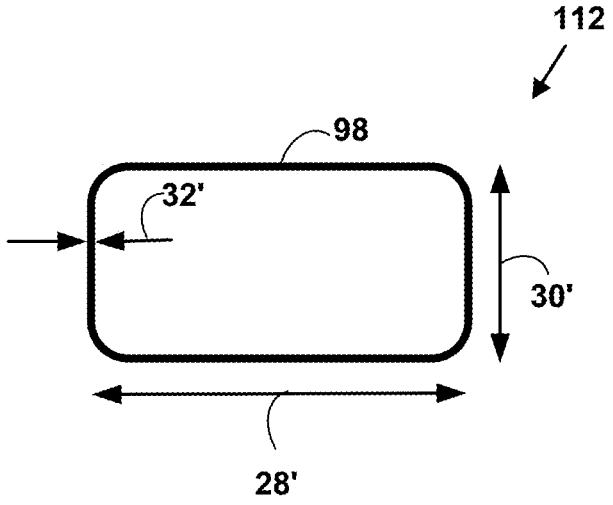
FIG. 9 is a cross section view of a hollow rectangular gripping portion the exemplary configurable golfing apparatus.

FIG. 9 is a cross section view 112 of the hollow rectangular gripping portion 98 the exemplary configurable golfing apparatus 96.

In an exemplary embodiment in FIG. 9, the hollow rectangular gripping portion 98 includes a rectangular shape with rounded corners. In another embodiment, the hollow rectangular gripping portion 98, includes fully rounded corners, semi-rounded corners, square corners, other shaped corners, etc.

In one exemplary embodiment, in FIG. 9, the hollow rectangular gripping portion 98 includes a width 28', of about one inch (about 2.54 cm) a height 30' of about three-quarters of an inch (about 1.91 cm) and a thickness 32' of about one-sixth inches (about 0.16 cm) to about one-quarter inches (about 0.635 cm). However, the present invention is not limited to such an embodiment and other embodiments can also be used to practice the invention.

In one embodiment, the thickness 32' of the exemplary hollow rectangular gripping portion 98 may vary in thickness for selected sides. For example, the thickness of the two sides comprising width 28' may be thicker than the two sides comprising the height 30', and vice-versa. In other embodiment, the thickness 32' of the hollow rectangular gripping portion 98 may vary in thickness for one to all selected sides. The hollow rectangular gripping portion 98 allows a golfer to select and use a large number of plural different rectangular-based hand gripping configurations and positions on the hollow rectangular gripping portion 98. However, the present invention is not limited to this embodiment and other embodiments with other sizes for the width, height and thickness can be used to practice the invention.

In another embodiment, the hollow rectangular gripping portion 98 is produced with pre-determined dimensions smaller than those illustrated in FIG. 9 to allow the hollow rectangular gripping portion 98 to be used by teen and child golfers whose hands are smaller than adult golfers. For example a width 28' of three-quarters of an inch (about 1.91 cm) a height 30' of about one-half of an inch (about 0.127 cm), etc. However, the present invention is not limited to this embodiment and other embodiments with other sizes for the width, height and thickness can be used to practice the invention.

In another embodiment, the hollow rectangular gripping portion 98 is replaced with another type of handle gripping portion comprising another shape comprising a circular, oval, square, triangle, polygon (e.g., pentagon, hexagon, heptagon/septagon, octagon, etc.) and/or other shape, multiple graduated shapes (e.g., large-to-small shapes (a large circle with a first diameter, a second smaller circle with a second smaller diameter, a third smaller circle with a third smaller diameter, etc.) included on the gripping handle 98 in a graduated manner and/or small-to-large in a graduated manner, etc.) that includes and encases the golf club shaft 100. However, the present invention is not limited to such embodiments and other embodiments and/or other shapes can be used to practice the invention.

In such an embodiment, the golf club shaft holder 102, 104, 110 would comprises a different shape suitable for insertion into the handle gripping portion 98 with a shape different than a rectangle. However, the present invention is not limited to such embodiments and other embodiments can be used to practice the invention.

In one embodiment, the exemplary hollow rectangular gripping portion 98 includes wood, metal, rubber, plastic, composite materials, graphene, graphite, fiberglass, carbon fiber and/other types of materials and/or various combinations thereof. However, the present invention is not limited to such embodiments and more, fewer or other types of materials can be used to practice the invention.

The hollow rectangular gripping portion 98 provides plural new rectangular gripping points and gripping positions and complying with cross sectional dimensions, axis of a grip and two grip requirements for a golf club grip used by professional golfers. The golf club shaft 100 is secured and enclosed within the rectangular gripping portion fully operational as a golf club shaft and complying with straightness, bending and flexibility, twisting and torque, properties and golf club head attachment requirements for a golf club shaft used by professional golfers.

In one embodiment, hollow rectangular gripping portion 98 complies with all requirements of the United States Golf Association (USGA) Equipment Rules, Section 2.3, the Grip, including complying with cross sectional dimensions, axis of a grip and two grip requirements for a golf club grip. The USGA Equipment Rules, dated First Edition, Jan. 1, 2019, including Section 2.3, are incorporated herein by reference.

In one embodiment, the hollow rectangular gripping portion 98 minimizes asymmetric deflections that could occur during use of the golf club 96 because of external and internal geometry of the rectangular shape of the hollow rectangular gripping portion 98.

In one embodiment, the golf club shaft 100 complies with all requirements of the United States Golf Association (USGA) Equipment Rules, Section 2.2, the Shaft, including complying with straightness, bending (e.g., flex, etc.) and twisting (e.g., torque, etc.) properties and attachment to a golf club head 108 requirements. The USGA Equipment Rules, dated First Edition, Jan. 1, 2019, including Section 2.2, are incorporated herein by reference.

In one embodiment, the hollow rectangular gripping portion 98 provides a gripping handle that completely encases the golf club shaft 100 to provide additional rectangular gripping functionality to the golf club shaft 100, without affecting the operating characteristics of the golf club shaft 100. The hollow rectangular gripping portion 98 complies with all requirements of the USGA for grips and the golf club shaft 100 complies with all requirements of the USGA for golf club shafts. The golf club shaft 100 is fully functional and functions the same as a golf club that is not enclosed and secured inside the hollow rectangular gripping portion 98.

In another embodiment, the hollow rectangular gripping portion 98 provides a gripping handle that completely encases the golf club shaft 100 that also complies with the Royal and Ancient (R&A) Golf Club of St Andrews rules and regulations, 2019 edition. The R&A rules of golf, 2019 edition, the contents of which are incorporated by reference. In another embodiment, the hollow rectangular gripping portion 98 provides a gripping handle that partially encases the golf club shaft 100. However, the present invention is not limited to such embodiments and other embodiments may be used to practice the invention.

In one embodiment, the hollow rectangular gripping portion 98 includes a portion of a hollow adult and/or youth hockey stick handle. However, the present invention is not limited to this embodiment and other embodiments not using hockey stick handles can be used to practice the invention.

In such an embodiment, the hollow adult hockey stick handle includes a width 28', of about one and 5/32 inches (about 2.94 cm), a height 30' of about three-quarters of an inch (about 1.91 cm) and a thickness 32' of about one-sixth inches (about 0.16 cm) to about one-quarter inches (about 0.635 cm). The hollow youth hockey stick handle includes a width 28' of one-half inch (about 1.27 cm) a height 30' of about one-half of an inch (about 1.27 cm), etc. and a thickness 32' of about one-sixth inches (about 0.16 cm) to about one-quarter inches (about 0.635 cm). However, the present invention is not limited to these embodiments and other measurements and other types of hollow hockey stick handles can be used to practice the invention.

In another embodiment, the hollow rectangular gripping portion 98 is replaced with a portion of a hollow adult and/or youth lacrosse stick handle. The adult lacrosse stick is a round and/or oval shape about 3.5 inches (about 8.9 cm) in circumference (i.e., a circumference is a perimeter of a circle or ellipse). The youth lacrosse stick is a round and/or oval shape about 2.5 inches (about 6.4 cm) in circumference. However, the present invention is not limited to these embodiments and other measurements and other types of hollow lacrosse stick handles can be used to practice the invention.

In another embodiment, the hollow rectangular gripping portion 98 is replaced with a portion of a hollow baseball bat shaped handle. In such an embodiment, the hollow baseball shaped handle is graduated shaped about 2% inches (about 6.67 cm) in diameter at its largest part and not less than about fifteen-sixteenths (15/16) inches (about 2.38 cm) in diameter at its smallest part. However, the present invention is not limited to these embodiments and other measurements and other types of hollow lacrosse stick handles can be used to practice the invention.

Figure 16:
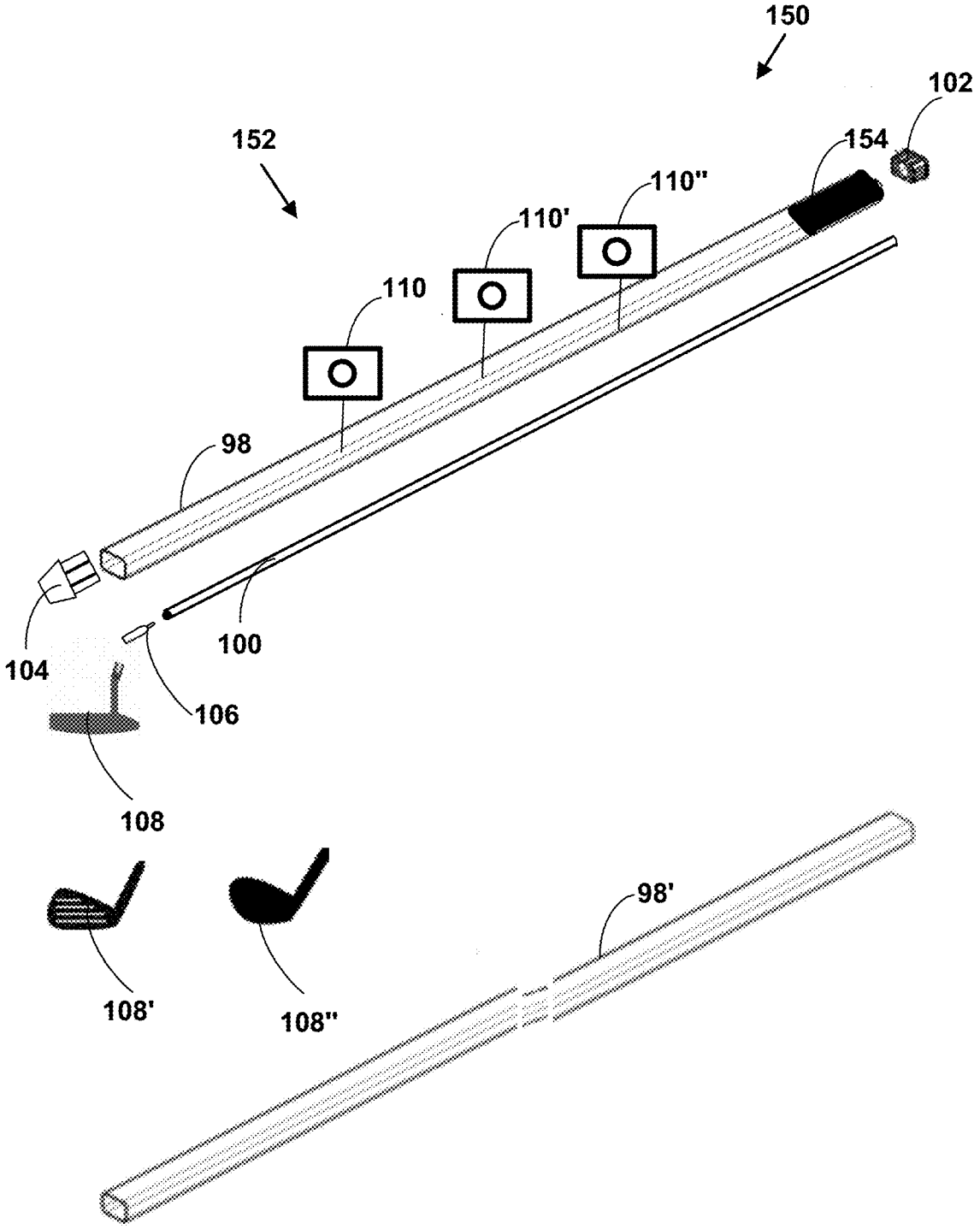
FIG. 16 is a block diagram illustrating exemplary additional components of the exemplary configurable golfing apparatus.

In another embodiment, the hollow rectangular gripping portion 98 comprises plural pieces 98' (FIG. 16). In one embodiment, the plural pieces 98' include plural interlocking pieces. However, the present invention is not limited to these embodiments and other measurements and other types of hollow lacrosse stick handles can be used to practice the invention.

However, the present invention is not limited to these embodiments and such embodiments may not be USGA and/or R&A rules approved and other embodiments may be used to practice the invention that are and/or are not, USGA and/or R&A rules approved.

In one embodiment, the golf club shaft 100 includes a circular, oval, square, triangle, polygon (e.g., pentagon, hexagon, heptagon/septagon, octagon, etc.) and/or other shape, multiple graduated shapes (e.g., large-to-small shapes included on the golf club shaft in a graduated manner and/or small-to-large in a graduated manner, etc.). In such an embodiment, the golf club shaft holder 102, 104 would include a different receptacle for holding and securing a golf club shaft 100 of a desired shape. However, the present invention is not limited to such embodiments and other embodiments can be used to practice the invention.

Figure 10:
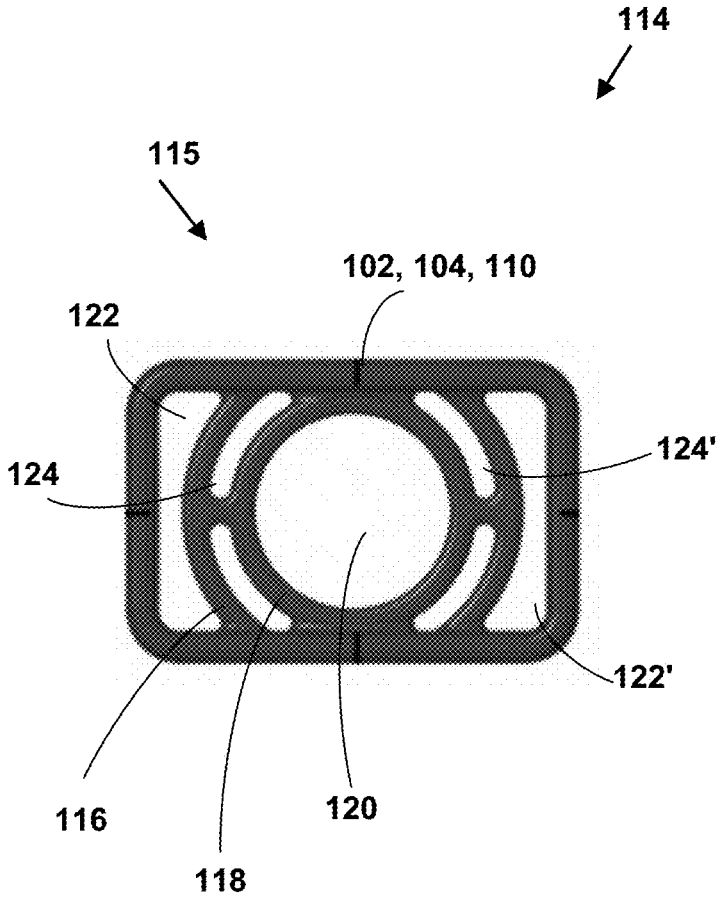
FIG. 10 is a block diagram illustrating a top view of an exemplary golf club shaft holder design for a hollow rectangular gripping portion of the exemplary configurable golfing apparatus.

FIG. 10 is a block diagram illustrating a top view 116 of an exemplary golf club shaft holder 102, 104, 110 and internal design 115 for the exemplary configurable golfing apparatus 96.

In FIG. 10, the golf club shaft holder design 102, 104, 110 includes plural support and shock absorbing components 116, 118 that form a receptacle 120 for inserting, engaging and securely holding at least the top and bottom ends of the golf club shaft 100. In one embodiment, the receptacle 120 includes a circular and/or oval shape for holding a circular and/or oval shaped golf club shaft 100. However, the present invention is not limited to circular and/or oval shaped receptacle and other receptacles 120 in the golf club shaft holders 102, 104, 110, can be used to practice the invention. However, the present invention is not limited to the designs and shapes described and illustrated in FIG. 10 and other designs and shapes can be used to practice the invention.

The exemplary golf club shaft holder 102, 104, 110 with internal design 115 illustrated in FIG. 10 is illustrated with plural hollow receptacles 122, 122', 124, 124' to support and control the operation of the golf club shaft 100 within the hollow rectangular gripping portion 98. However, the present invention is not limited to such an embodiment and other embodiments with and/or without the plural hollow receptacles 122, 122', 124, 124'.

It has been determined experimentally that the internal design 115 of the exemplary golf club shaft holder 102, 104, 110 is one optimal design for supporting and controlling the operation of the golf club shaft 100 within the hollow rectangular gripping portion 98, including optimal force and optimal shock absorption when the golf club head 108 is used to strike a golf ball. However, the present invention is not limited to this design and other designs can be used to practice the invention.

Figure 11A:
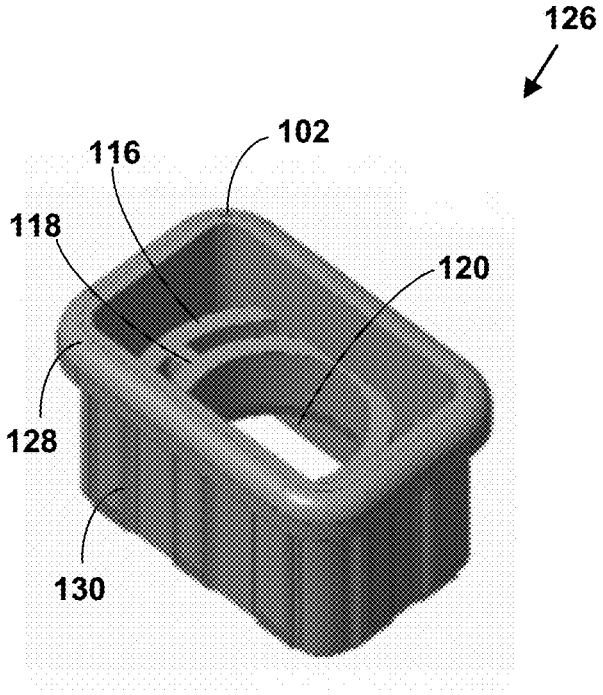
FIG. 11A is a block diagram illustrating a top perspective view of an exemplary first golf club shaft holder for the exemplary configurable golfing apparatus.

FIG. 11A is a block diagram 126 illustrating a top perspective view of the exemplary first golf club shaft holder 102 for the exemplary configurable golfing apparatus 96.

Figure 11B:
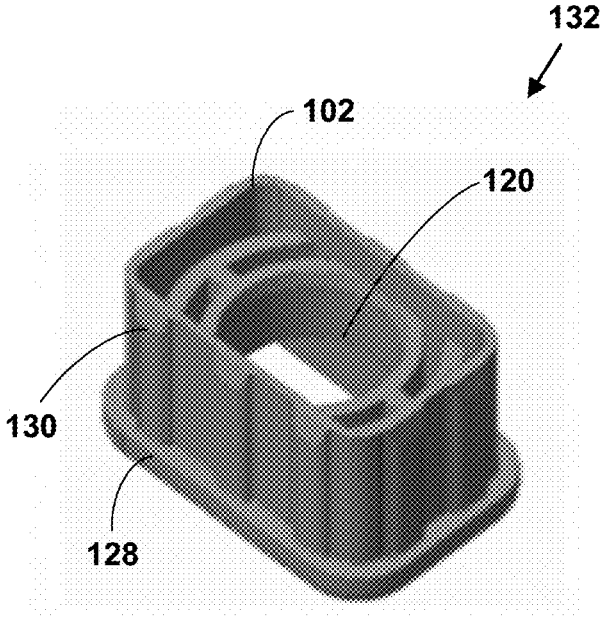
FIG. 11B is a block diagram illustrating a top perspective view of the exemplary first golf club shaft holder for the exemplary configurable golfing apparatus.

FIG. 11B is a block diagram illustrating a bottom perspective view 132 of the exemplary first golf club shaft holder 102 for the exemplary configurable golfing apparatus 96.

However, the present invention is not limited to the design illustrated in FIG. 11 and other designs can be used to practice the invention.

In FIG. 11 the exemplary first golf club shaft holder 102 includes a lip portion 128 extending beyond the edges of the hollow rectangular gripping portion 98 to allow the exemplary first golf club shaft holder 102 to be dynamically inserted and removed from the hollow rectangular gripping portion 98. The lip portion 128 prevents the exemplary first golf club shaft holder 102 from slipping within the hollow rectangular gripping portion 98. In another embodiment, the exemplary first golf club shaft holder 102 does not include the lip portion 128 (e.g., 110, etc.) In such an embodiment, the exemplary first golf club shaft holder 102 is manufactured as exemplary first golf club shaft holder 110 and is integral and encased completely inside the hollow rectangular gripping portion 98, is permanently attached and cannot be removed. However, the present invention is not limited to such embodiments and other embodiments can be used to practice the invention.

The exemplary first golf club shaft holder 102 further includes a ribbed portion 130 for engaging and holding the exemplary first golf club shaft holder 102 within the hollow rectangular gripping portion 98. In such an embodiment, the a ribbed portion 130 holds the exemplary first golf club shaft holder 102 within the hollow rectangular gripping portion 98 with a friction mount and allows the exemplary first golf club shaft holder 102 to be easily and dynamically inserted and removed from the hollow rectangular gripping portion 98. In another embodiment, the exemplary first golf club shaft holder 102 is coated with an adhesive so the exemplary first golf club shaft holder 102 cannot removed and stays in a stationary position. In another embodiment, the exemplary first golf club shaft holder 102 is manufactured integral to the hollow rectangular gripping portion 98 as exemplary golf club shaft holder 110, is permanently attached and cannot be removed. However, the present invention is not limited to the designs described and illustrated in FIG. 11 and other designs can be used to practice the invention.

Figure 12:
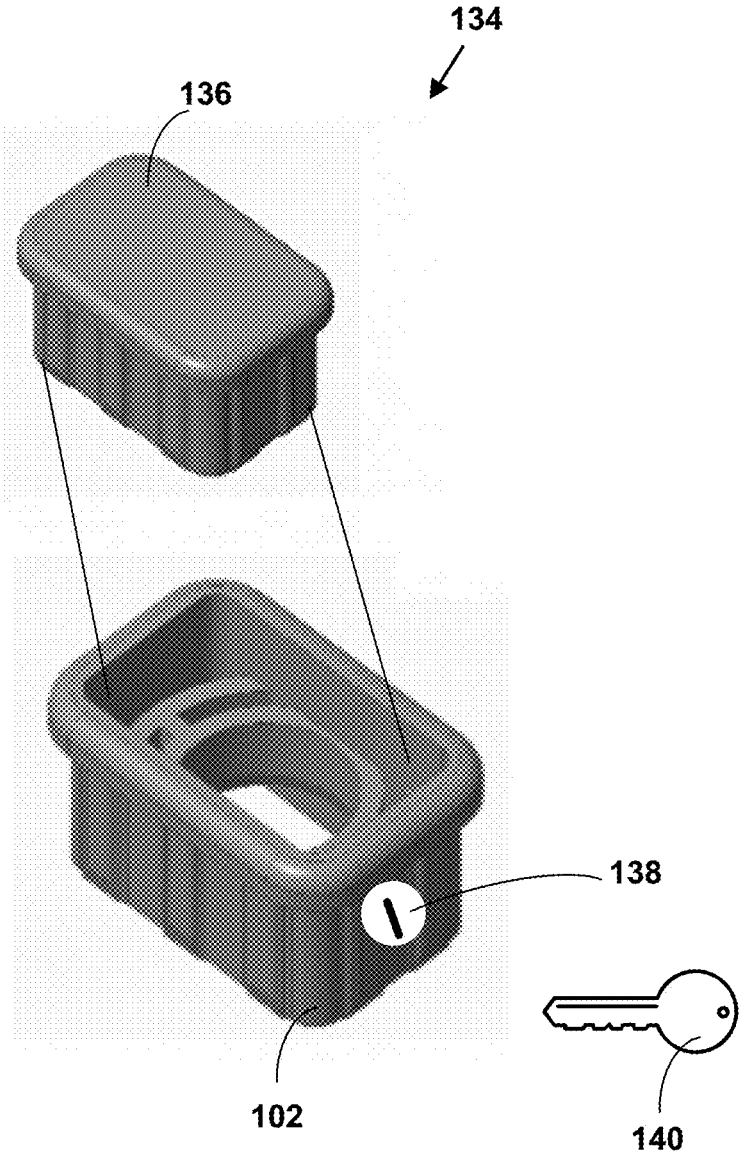
FIG. 12 is a block diagram illustrating a top perspective view of an end cap for the exemplary first golf club shaft holder for the exemplary configurable golfing apparatus.

FIG. 12 is a block diagram 134 illustrating a top perspective view of an end cap 136 for the exemplary golf club shaft holder 102 for the exemplary configurable golfing apparatus 96.

In FIG. 12, the end cap 136 is used to seal and protect the exemplary first golf club shaft holder 102 and prevent foreign bodies (e.g., water, dirt, etc.) from entering the hollow rectangular gripping portion 98 the exemplary golf club apparatus 96. In one embodiment, the end cap 126 is dynamically insertable and removable from the exemplary first golf club shaft holder 102. In such an embodiment, removal of the end cap 136 allows the additional components described for FIG. 18 to be dynamically inserted and removed for non-professional golf play. In another embodiment, the exemplary first golf club shaft holder 102 further includes a lock 138 and key component 140 that allows the end cap 136 to be locked and unlocked to dynamically insert and remove the additional components described for FIG.

18. However, the present invention is not limited to these embodiments and other embodiments can be used to practice the invention.

In another embodiment, the end cap 136 is coated with an adhesive so it cannot be removed from the exemplary first club shaft holder 102. In another embodiment, the end cap 136 is manufactured integral to the exemplary first club shaft holder 102, is permanently attached and cannot be removed. However, the present invention is not limited to the designs described and illustrated in FIG. 12 and other designs can be used to practice the invention.

In one embodiment, the exemplary second golf club shaft holder 104 is identical to the exemplary first golf club shaft holder 102. In another embodiment, the first golf club shaft holder 102 and the second golf club shaft holder are not identical. However, the present invention is not limited to such an embodiment and other embodiments can be used to practice the invention.

Figure 13:
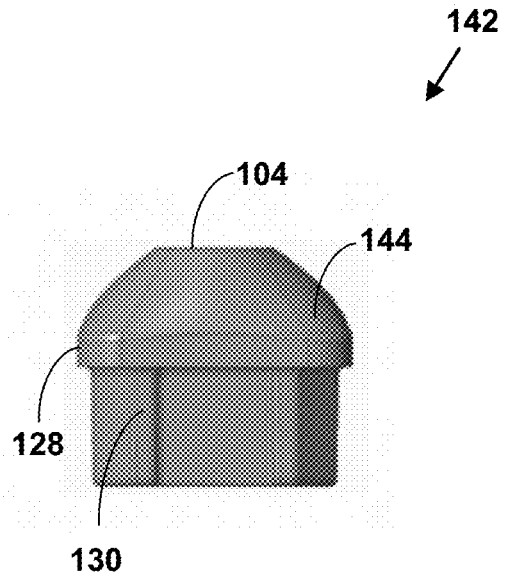
FIG. 13 is block diagram illustrating a side view of an exemplary second golf club shaft holder for the exemplary configurable golfing apparatus.

FIG. 13 is block diagram 142 illustrating a side view of an exemplary second golf club shaft holder 104 for the exemplary configurable golfing apparatus 96. However, the present invention is not limited to the design illustrated in FIG. 13 and other designs for the exemplary second golf club shaft holder 104 can be used to practice the invention.

In FIG. 13, the exemplary second golf club shaft holder 104 includes a tapered component 144 and a lip portion 128 extending beyond the edges of the hollow rectangular gripping portion 98 to allow the exemplary second golf club shaft holder 104 to be dynamically inserted and removed to and from the hollow rectangular gripping portion 98. The tapered component 144 allows the golf club head connection component 106 to dynamically insert and remove one or more different golf club heads 108, 108', 108" into the golf club shaft 100 without interference with the component. The lip portion 128 prevents the exemplary second golf club shaft holder 104 from slipping within the hollow rectangular gripping portion 98. In another embodiment, the exemplary second golf club shaft holder 104 does not include the lip portion. In such an embodiment, the exemplary second golf club shaft holder 104 is manufactured integral to the hollow rectangular gripping portion 98, is permanently attached and cannot be removed. However, the present invention is not limited to such embodiments and other embodiments can be used to practice the invention.

The exemplary second golf club shaft holder 104 further includes a ribbed portion 130 for engaging and holding the exemplary second golf club shaft holder 104 within the hollow rectangular gripping portion 98. In such an embodiment, the a ribbed portion 130 holds the exemplary second golf club shaft holder 104 within the hollow rectangular gripping portion 98 with a friction mount and allows the exemplary second golf club shaft holder 104 to be easily and dynamically inserted and removed from the hollow rectangular gripping portion 98. In another embodiment, the exemplary second golf club shaft holder 104 is coated with an adhesive so the exemplary second golf club shaft holder 104 cannot removed. In another embodiment, the exemplary second golf club shaft holder 104 is manufactured integral to the hollow rectangular gripping portion 98 as exemplary golf club shaft holder 110, is permanently attached and cannot be removed. However, the present invention is not limited to the designs described and illustrated in FIG. 13 and other designs can be used to practice the invention.

Figure 14:
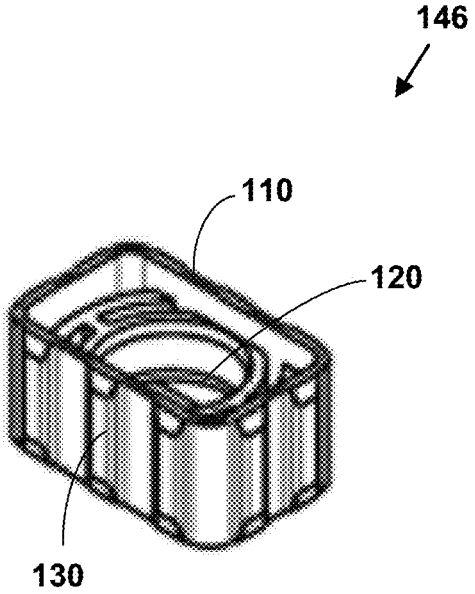
FIG. 14 is a block diagram illustrated side view perspective view of an exemplary internal golf club shaft holder for the exemplary configurable golfing apparatus.

FIG. 14 is a block diagram 146 illustrating a side view perspective view of an exemplary internal golf club shaft holder 110 for the exemplary configurable golfing apparatus 96.

The exemplary internal golf club shaft holder 110 includes internal design 115 and ribbed portion 130 for engaging and holding the exemplary internal golf club shaft holder 110 within the hollow rectangular gripping portion 98. However, the exemplary internal golf club shaft holder 110 includes does not include lip portion 128.

In such an embodiment, the a ribbed portion 130 holds the exemplary internal golf club shaft holder 110 within the hollow rectangular gripping portion 98 with a friction mount and allows the exemplary internal golf club shaft holder 110 to be easily and dynamically inserted into and removed from the hollow rectangular gripping portion 98 and/or dynamically moved to new and different positions within the hollow rectangular gripping portion 98 to dynamically change the golf club shaft 100 operates when striking a golf ball. In another embodiment, the exemplary internal golf club shaft holder 110 is coated with an adhesive so the exemplary internal golf club shaft holder 110 cannot removed. In another embodiment, the exemplary internal golf club shaft holder 110 is manufactured integral to the hollow rectangular gripping portion 98 as exemplary golf club shaft holder 110, is permanently attached and cannot be removed. However, the present invention is not limited to the designs described and illustrated in FIG. 14 and other designs can be used to practice the invention.

Figure 15:
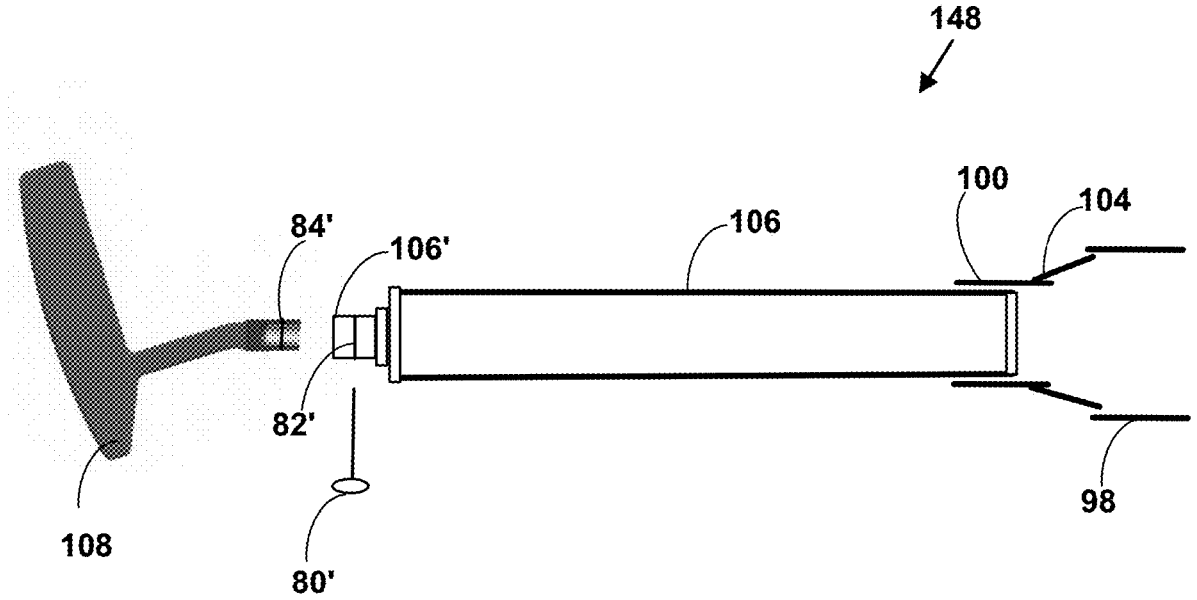
FIG. 15 is a side view of a golf club head connection component for the exemplary configurable golfing apparatus.

FIG. 15 is block diagram 148 illustrating a side view of a golf club head connection component 106 for the exemplary configurable golfing apparatus 96.

In FIG. 15 the golf club head connection component 106 inserts into the golf club shaft 100, which inserts into the exemplary second golf club shaft holder 104, which inserts into the hollow rectangular gripping portion 98.

In one embodiment, the golf club head connection component 106 includes a metal connection component 106' that is lined with a rubber and/or plastic and/or other material to keep the golf club head 108 in place with a friction mounting force. However, the present invention is not limited to such an embodiment and other embodiments with other materials can be used to practice the invention.

In one embodiment, the golf club head connection component 106' further includes one or more connection means 80' (e.g., removable/insertable pin, locking pin, rivet, screw, bolt, etc.) for securing the golf club head 108 into the golf club head connection component 106'. In such an embodiment, the golf club head connection component 106' further includes one or more hollow receptacles 82' for accepting the connection means 80' and the golf club head 108 includes one or more hollow receptacles 84' for accepting the one or more connection means 80. The hollow receptacles 82', 84' are illustrated for simplicity with a vertical orientation (e.g., ninety degrees, etc.) to accept the connection means 80'. However, the hollow receptacles 82', 84' can be any orientation to accept the connection means 80' at any angle to practice the invention. The golf club head 108 is attached to the golf club head connection component 106' according to USGA and/or R&A rules. In another embodiment, the golf club head 108 includes a threaded connection means and the golf club head connection component 106 includes a threaded receptacle for accepting the threaded connection means. However, the present invention is not limited to these embodiments and other embodiments can be used to practice the invention.

In FIGS. 8, 15 and 16 the golf club head 108 includes a golf club comprising a putter. However, the present invention is not limited to such an embodiment and other golf club heads can be used to practice the invention.

FIG. 16 is a block diagram 150 illustrating exemplary additional components 152 of the exemplary configurable golfing apparatus 96.

FIG. 16 illustrates three additional internal golf club shaft holders 110, 110', 110". The additional internal golf club shaft holders 110, 110', 110" are placed at desired distances and provide desired spacing to meet requirements of individual golfers based on their age, height, weight, strength, golf ball hitting force, golf club shaft 100 type (e.g., metal, plastic, graphite, etc.) and/or other requirements and/or factors. However, the present invention is not limited to such embodiments and the invention can be practiced with and/or without the additional one or more internal golf club shaft holders 110, 110', 110". In addition, the exemplary golf club apparatus is not limited to the components described, as more, fewer and other components can be used to practice the invention.

In another embodiment, the hollow rectangular gripping portion 98 further includes another gripping portion 154 of a pre-determined length of at least seven inches (about 17.78 centimeters) that is slightly larger in size than the rest of the hollow rectangular gripping portion 98. In addition, hollow rectangular gripping portion 98 may further include its surfaces covered by a gripping material (e.g., rubber, plastic, etc.) including the gripping portion 154, different and/or the same as, the hollow rectangular gripping portion 98 to allow for more secure and/or comfortable gripping. In such an embodiment, the additional gripping section 154 complies with the USGA two grip requirement rules. However, the present invention is not limited to such embodiments and other embodiments can be used to practice the invention.

FIG. 16 illustrates exemplary configurable golfing apparatus 96 with additional internal golf club shaft holders 110, 110', 110", additional gripping portion 154 and additional golf club heads including, but not limited to, an iron head 108', and a driver head 108".

The exemplary configurable golfing apparatus 96 and/or separate components and combinations thereof, are injection molded, extruded, pultruded, pull-winded, 3D-printed, manufactured, assembled and/or produced with other techniques using one or more the materials described herein. However, the present invention is not limited to such an embodiment and more, fewer or other types manufacturing techniques can be used to practice the invention.

In one embodiment, the hollow rectangular gripping portion 98 includes a rectangular gripping handle only and does not comply with all requirements of the USGA Equipment Rules, Section 2.2, for a golf club shaft 100 including straightness, bending (e.g., flex, etc.) and twisting (e.g., torque, etc.) properties and attachment to a golf club head 108 requirements as was described for FIG. 3 above. However, in such an embodiment, the golf club shaft 100 enclosed within the hollow rectangular gripping portion 98 does comply with all such USGA golf club shaft 100 requirements and it operates as though it was not enclosed within the hollow rectangular gripping portion 98. The hollow rectangular gripping portion 98 also complies with all such USGA requirements for a golf club grip. Therefore, the golf club shaft 100 enclosed within the hollow rectangular gripping portion 98 meet USGA requirements required for a golf club 96. However, the present invention is not limited to such embodiments and other embodiments can be used to practice the invention.

In another embodiment, the exemplary configurable golfing apparatus 96 includes only the hollow rectangular gripping portion 98, exemplary golf club shaft holders 102, 104, golf club head connection component 106 and golf club head 108, but without golf club shaft 100. See also FIGS. 1-7 and related text. In such an embodiment, the exemplary configurable golfing apparatus 96 complies with all requirements of the USGA Equipment Rules, Section 2.2, for a golf club shaft including straightness, bending (e.g., flex, etc.) and twisting (e.g., torque, etc.) properties and attachment to a golf club head 108 requirements and Section 2.3 Section 2.3, the Grip, including complying with cross sectional dimensions, axis of a grip and two grip requirements for a golf club grip. However, the present invention is not limited to such embodiments other embodiments can be used to practice the invention.

In another embodiment, the exemplary configurable golfing apparatus 96 includes only the hollow rectangular gripping portion 98, exemplary golf club shaft holders 102, 104, golf club head connection component 106 and golf club head 108, but without golf club shaft 100. In such an embodiment, the exemplary configurable golfing apparatus 96 complies with Section 2.3, the Grip, including complying with cross sectional dimensions, axis of a grip and two grip requirements for a golf club grip but does not comply with Section 2.2 for a Golf Shaft. However, the present invention is not limited to such embodiments and other embodiments can be used to practice the invention.

Figure 17:
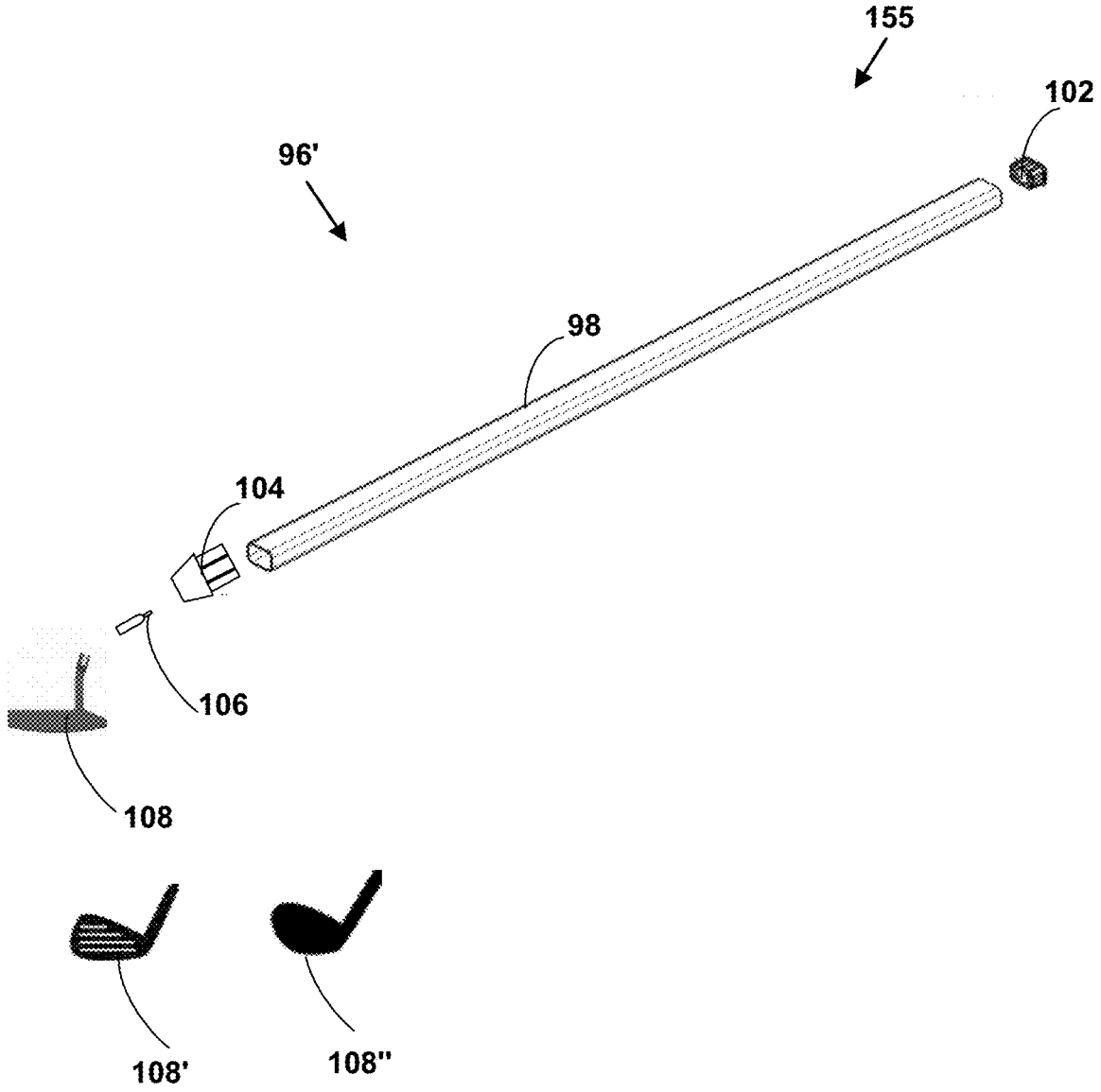
FIG. 17 is a block diagram illustrating a perspective view of another exemplary configurable golfing apparatus.

FIG. 17 is a block diagram 155 illustrating a perspective view of another exemplary configurable golfing apparatus 96' (Not drawn to scale).

FIG. 17 illustrates the exemplary configurable golfing apparatus 96' including only the hollow rectangular gripping portion 98, exemplary golf club shaft holders 102, 104, golf club head connection component 106 and golf club heads 108, 108', 108", but without golf club shaft 100. In such an embodiment, the golf club head connection component 106 with a golf club head 108, 108', 108" is inserted directly into exemplary second golf club shaft holder 104, which securely holds golf club head connection component 106 and golf club heads 108, 108', 108" for use during golf play.

In such an embodiment, the exemplary configurable golfing apparatus 96 complies with Section 2.3, the Grip, including complying with cross sectional dimensions, axis of a grip and two grip requirements for a golf club grip and with Section 2.2 for a Golf Shaft including straightness, bending (e.g., flex, etc.) and twisting (e.g., torque, etc.) properties and attachment to a golf club head 108. In another embodiment, the exemplary configurable golfing apparatus 96' complies with either Section 2.3, the Grip, including complying with cross sectional dimensions, axis of a grip and two grip requirements for a golf club grip or Section 2.2 for a Golf Shaft including straightness, bending (e.g., flex, etc.) and twisting (e.g., torque, etc.) properties and attachment to a golf club heads 108, 108', 108, but not both sections. However, the present invention is not limited to such embodiments and other combinations of using and not using a golf club shaft 100 and/or complying and/or not complying with USGA Rules sections 2.2 and 2.3 and/or R&A rules can be used to practice the invention.

Figure 18:
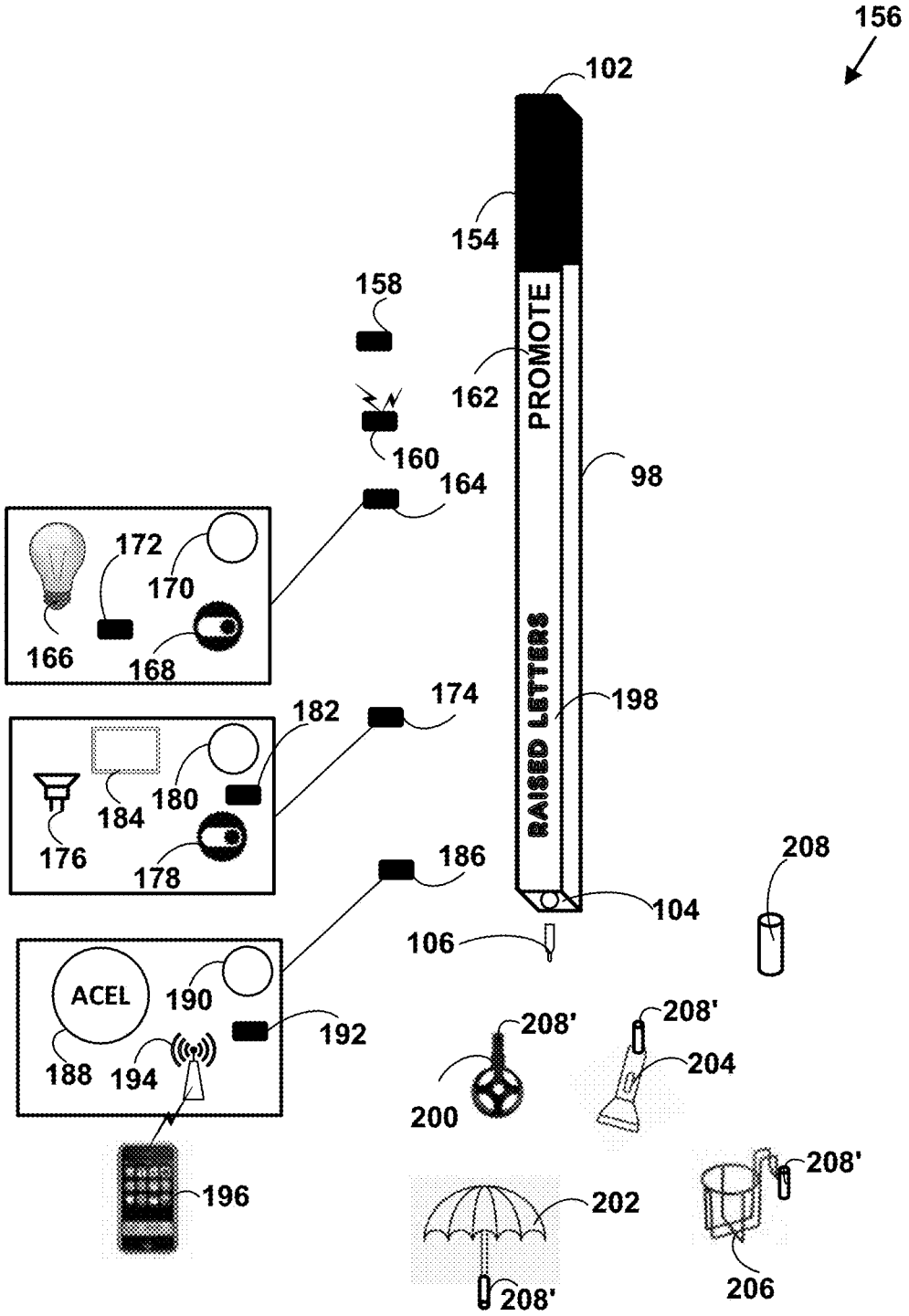
FIG. 18 is a block diagram illustrating exemplary additional components of the exemplary configurable golfing apparatus.

Non-Professional Use of the Exemplary Configurable Golfing Apparatus with Inserted Golf Shaft FIG. 18 is a block diagram 156 illustrating exemplary additional components of the exemplary configurable golfing apparatus 96.

When the exemplary configurable golfing apparatus 96 is used for non-professional golfing, the exemplary configurable golfing apparatus 96 includes one or more of the following additional components 158, 160, 162, 170, 174, 186, 200-208 (not drawn to scale in FIG. 18). However, the present invention is not limited to such an embodiment and other embodiments, with more, fewer and/or other additional components can be used to practice the invention.

The additional embodiments 158, 160, 162, 170, 174, 186, 200-208, will be used for non-professional golfers until the USGA may someday approve such items for inclusion in golf handles to be use by professional golfers.

The hollow rectangular gripping portion 98 of configurable golfing apparatus 96 further includes one or more weights 158 with a pre-determined size and shape to easily and securely slide inside the hollow rectangular gripping portion 98 allowing a golf club head 108, 108', 108" attached to the exemplary configurable golfing apparatus 96 to strike a golf ball with a greater force. However, the present invention is not limited to such an embodiment and other embodiments, with more, fewer and/or other additional components can be used to practice the invention.

The hollow rectangular gripping portion 98 of the configurable golfing apparatus 96 further including one or more magnets 160 allowing metal components including ball markers, golf tee holders, bottle/can openers and other metal objects to be temporarily attached to an exterior surface of the hollow rectangular gripping portion 98. However, the present invention is not limited to such an embodiment and other embodiments, with more, fewer and/or other additional components can be used to practice the invention.

The hollow rectangular gripping portion 98 of configurable golfing apparatus 96 further including a hollow component and made from a transparent material 162 that allows advertising, promotional materials, etc. to be dynamically inserted and removed into one or more of the four sides of the hollow rectangular gripping portion 98.

The hollow rectangular gripping portion 98 of configurable golfing apparatus 96 further including a hollow component and made from the transparent material 162 and further includes a lighting component 164 visible on one or more of the four sides of the hollow rectangular gripping portion 98 of the configurable golfing apparatus 96. However, the present invention is not limited to such an embodiment and other embodiments, with more, fewer and/or other additional components can be used to practice the invention.

In such an embodiment, the lighting component 164 includes, but is not limited to, small incandescent light bulbs, Light Emitting Diodes (LED) light bulbs 166 and/or other types of light bulbs and/or other types lighting components, an on/off switch component 168 and a battery component 170 connected with an electrical circuit 172. In one embodiment, the on/off switch component 168 extends outside, extends outside and/or does not extend outside, one of the surfaces of the hollow rectangular gripping portion 98 of the configurable golfing apparatus 96 for use. In such an embodiment, the hollow rectangular gripping portion 98 of the configurable golfing apparatus 96 is also used to advertise and/or promote goods and/or services, create interest among golfers and/or spectators and/or be used in low light and/or dark playing conditions. However, the present invention is not limited to such an embodiment and other embodiments, with more, fewer and/or other additional components can be used to practice the invention.

The hollow rectangular gripping portion 98 of the configurable golfing apparatus 96 further includes one or more audio/visual components 174. The one or more audio/visual components 174, include, but are not limited to, wireless speakers 176 (e.g., Bluetooth, etc.), an on/off switch component 178 and a battery component 180 connected with an electrical circuit 182. In one embodiment, the on/off switch component 178 extends outside and/or does not extend outside, one of the surfaces of the hollow rectangular gripping portion 98 of the configurable golfing apparatus 96 for use. The hollow rectangular gripping portion 98 of the configurable golfing apparatus 96 further includes a display screen 184 (e.g., Liquid Crystal Display (LCD), etc.). The wireless speakers 176 and display screen 184 allow the exemplary hollow rectangular gripping portion 98 of the configurable golfing apparatus 96 to accept and play audio and visual information such as music, weather reports, tee off times, course information, advertising, coupons, promotional information, etc. However, the present invention is not limited to such an embodiment and other embodiments, with more, fewer and/or other additional components can be used to practice the invention.

The hollow rectangular gripping portion 98 of the configurable golfing apparatus 96 further includes an accelerometer component 186. The accelerometer component 186 includes an accelerometer 188 with an electrical circuit 190 that is used to measure and record the path of the configurable golfing apparatus 96 as it is swung, the force by which the configurable golfing apparatus 96 impacts a golf ball, and other measurements, etc. In one embodiment, the accelerometer component 186 further includes a stroke recording component application 192 counting each time the accelerometer 188 exceeds a pre-determined force including a force when the configurable golfing apparatus 96 impacts a golf ball.

In such embodiments, the hollow rectangular gripping portion 98 of the configurable golfing apparatus 96 further includes a wireless component 194 that allows the accelerometer component 188 and the stroke recording component application 190 to send accelerometer data wirelessly (e.g., Bluetooth, Infrared, Near Field Communications (NFC), Machine-2-Machine (M2M), WiFi, 802.11x, cellular telephone, etc.) to an external network device 196 such as a smart phone, wearable network device (e.g., watches, glasses, fitness watches and activity bracelets, etc.), electronic tablet, laptop computer, desktop computer, Internet of Things (IoT), network device, etc. However, the present invention is not limited to such an embodiment and other embodiments, with more, fewer and/or other additional components can be used to practice the invention.

The hollow rectangular gripping portion 98 of the configurable golfing apparatus 96 further includes raised letters 198 and/or raised graphical objects on one or more of its four sides. In such an embodiment, the configurable golfing apparatus 96 is used to advertise and/or promote goods and/or services. In one embodiment, the configurable golfing apparatus 96 is manufactured with raised letters 198 integral on one or more of its four sides. In another embodiment, the raised letters 198 are dynamically added to the hollow rectangular gripping portion 98 of the configurable golfing apparatus 96. However, the present invention is not limited to such an embodiment and other embodiments, with more, fewer and/or other additional components can be used to practice the invention.

The hollow rectangular gripping portion 98 of the configurable golfing apparatus 96 further includes manufacturing the hollow rectangular gripping portion 98 including one or more different colors used to advertise and/or promote goods and/or services, sports teams, universities, colleges, etc. However, the present invention is not limited to such an embodiment and other embodiments, with more, fewer and/or other additional components can be used to practice the invention.

The hollow rectangular gripping portion 98 of the configurable golfing apparatus 96 further includes accepting other components into the, the exemplary first 102 and second 104 golf club shaft holders and/or the golf club head connection component 106, including, but not limited to, a golf ball retriever 200 used if a golf ball is hit into a body of water, an umbrella 202, a flashlight 204, beverage holder 206, and/or any additional useful components. The useful components can be dynamically inserted and removed into a top end and/or a bottom end of the configurable golfing apparatus 96.

In such embodiments, the additional components are provided with a connection adapter 208 for dynamically inserting and removing the additional components 200, 202, 204, 206 into the receptacle 120 included in the first golf club shaft holder 102, the second golf club shaft holder 104 and/or the golf club head connection component 106 in hollow rectangular gripping portion 98. The connection adapters 208', are specifically sized and shaped to fit into any sized and shaped receptacle 120 and internal design 115 for securely holding a golf club shaft 100 of any desired size (e.g., a desired diameter, etc.) and shape (e.g., circular, oval, etc.) In another embodiment, the additional components 200, 202, 204, 206 are manufactured with an integral connection adapter 208 to allow direct insertion into and removal from the receptacle 120 included in the first golf club shaft holder 102, the second golf club shaft holder 104 and/or the golf club head connection component 106 of hollow rectangular gripping portion 98 of the configurable golfing apparatus 96.

In one embodiment for example, the additional components 200, 202, 204, 206 can be inserted into a top end of the receptacle 120 included in the first golf club shaft holder 102, the second golf club shaft holder 104 and/or the golf club head connection component 106, via the first golf club shaft holder 102 while a golf club head 108 is still attached to the golf club shaft 100 via the golf club head connection component 106. In another embodiment, the additional components 200, 202, 204, 206 are attached into the golf club head connection component 106 after removing the golf club head 108. In another embodiment, the additional components 200, 202, 204, 206 are attached via the second golf club shaft holder 104 after removing the golf club head connection component 106 and the attached golf club head 108. However, the present invention is not limited to such embodiments and other embodiments, with more, fewer and/or other additional components and/or other combinations of connections can be used to practice the invention.

The configurable golfing, apparatus described herein includes, but is not limited to, a golf club handle that is rectangular in shape with rounded corners. The rectangular golf club handle includes a golf club shaft that is securely mounted within the rectangular golf club handle. The rectangular shape provides new and additional hand placement and new and additional gripping configurations for both right handed and left handed golfers. The configurable golf apparatus allows different golf club heads (e.g., drivers, irons, putters, etc.) to be dynamically inserted and removed from the configurable golf club handle. The golf club shaft inside the rectangular golf club handle complies with straightness, bending and flexibility, and twisting and torque, properties and attachment to a golf club head requirements for a golf club shaft required by the United States Golf Association (USGA). The rectangular golf club handle complies with the cross sectional dimensions, axis of a grip and two grip requirements for a golf club grip required by the USGA. The configurable golfing apparatus meets the requirements for use by professional golfers by USGA and Royal and Ancient (R&A) Golf Club of St Andrews rules. In addition, for non-professional golfers, the configurable golfing apparatus includes additional components (e.g., lighting, audio, accelerometer, etc.) to use the configurable golfing apparatus as a training tool and/or to use the golf club handle as an instrument to increase an amount of fun obtained from playing a round of golf that are not currently allowed by the USGA or R&A rules.

It should be understood that the architecture, programs, processes, methods and systems described herein are not related or limited to any particular type of specific component or material unless indicated otherwise. Various types of components and materials may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer elements may be used in the block diagrams.

While various elements of the preferred embodiments have been described as being implemented in specific materials, in other embodiments other materials and implementations may alternatively be used, and vice-versa.

The claims should not be read as limited to the described order or elements unless stated to that effect. In addition, use of the term "means" in any claim is intended to invoke 35 U.S.C. § 112, paragraph 6, and any claim without the word "means" is not so intended.

Therefore, all embodiments that come within the scope and spirit of the following claims and equivalents thereto are claimed as the invention.

I claim:

1. A configurable golfing apparatus, comprising in combination:

a hollow rectangular gripping portion for enclosing a golf club shaft;

the golf club shaft secured and enclosed within the hollow rectangular gripping portion with a plurality of golf club shaft holders;

a first golf club shaft holder located at a first top end of the hollow rectangular gripping portion for engaging and securely holding a first top end of the golf club shaft within the rectangular gripping portion, the first golf club shaft holder including a first receptacle for inserting, engaging and securely holding the first top end of the golf club shaft;

a second golf club shaft holder located at a second end of the rectangular gripping portion for engaging and securely holding a second bottom end of the golf club shaft within the hollow rectangular gripping portion, the second golf club shaft holder including a second receptacle for inserting, engaging and securely holding the second bottom end of the golf club shaft;

a plurality of internal golf club shaft holders placed at desired distances within the hollow rectangular gripping portion, the plurality of internal golf club shaft holders comprising:

a rectangular component;

a circular or oval shaped center component connected within the rectangular component with a circular or oval shaped receptacle engaging and securely holding the golf club shaft, a plurality of support and shock absorbing components connected to the circular or oval shaped center component enclosing a plurality of hollow receptacles, a plurality of other hollow receptacles between the plurality of support and shock absorbing components and the rectangular component, the plurality of support and shock absorbing components and the plurality of other hollow receptacles providing optimal force absorption and optimal shock absorption when a golf club head connected to the golf club shaft is used to strike a golf ball; and a golf club head connection component for dynamically inserting and removing one or more different golf club heads into the golf club shaft, the golf club head connection component attached to the second bottom end of the golf club shaft, the hollow rectangular gripping portion providing a plurality of new rectangular gripping points and positions on the configurable golfing apparatus and complying with cross sectional dimensions, axis of a grip and two grip requirements for golf club grips used by professional golfers, the golf club shaft secured and enclosed within the hollow rectangular gripping portion fully operational as a golf club shaft and complying with straightness, bending and flexibility, twisting and torque, properties and golf club head attachment requirements for golf club shafts used by the professional golfers.

2. The configurable golfing apparatus of claim 1 wherein the hollow rectangular gripping portion includes a wood, metal, rubber, plastic, composite materials, graphene, graphite, carbon fiber, fiberglass material, or combination thereof.

3. The configurable golfing apparatus of claim 1 wherein the hollow rectangular gripping portion further includes an end cap component on an end of the hollow rectangular gripping portion with a lock and key component allowing the end cap component to be dynamically locked and unlocked to dynamically insert and remove additional components within the hollow rectangular gripping portion.

4. The configurable golfing apparatus of claim 1 wherein the hollow rectangular gripping portion further includes an additional gripping portion of a per-determined length for more secure and comfortable gripping of the hollow rectangular gripping portion.

5. The configurable golfing apparatus of claim 1 wherein the golf club shaft includes a wood, metal, rubber, plastic, composite materials, graphene, graphite, carbon fiber, or fiberglass material, or combination thereof.

6. The configurable golfing apparatus of claim 1 wherein the first and second golf club shaft holders includes a wood, metal, rubber, plastic, composite materials, graphene, graphite, carbon fiber, fiberglass material, or combination thereof.

7. The configurable golfing apparatus of claim 1 wherein individual components of the configurable golfing apparatus, are injection molded, extruded, pultruded, pull-winded, 3D-printed, manufactured, assembled, or combinations thereof and comprise one or more different materials.

8. The configurable golfing apparatus of claim 1 wherein the golf club shaft inside the hollow rectangular gripping portion complies with all complies with all requirements of the United States Golf Association (USGA) Equipment Rules, Section 2.2, the Shaft, including complying with straightness, bending and flexibility, and twisting and torque, properties and attachment to a golf club head requirements for a golf club shaft.

9. The configurable golfing apparatus of claim 1 wherein the hollow rectangular gripping portion complies with all requirements of the United States Golf Association (USGA) Equipment Rules, Section 2.3, the Grip, including complying with cross sectional dimensions, axis of a grip and two grip requirements for a golf club grip.

10. The configurable golfing apparatus of claim 1 wherein the hollow rectangular gripping portion provides a plurality of different hand placements and a plurality of additional gripping configurations for both right handed and left handed golfers.

11. The configurable golfing apparatus of claim 1 wherein the first golf club shaft holder further includes a dynamically enterable and removable end cap to seal and protect the first golf club shaft holder and prevent foreign bodies from entering the hollow rectangular gripping portion of the configurable golfing apparatus.

12. The configurable golfing apparatus of claim 1 wherein the first golf club shaft holder, the second golf club shaft holder, the golf club shaft and the golf club head connection component are dynamically insertable into and removable from the hollow rectangular gripping portion of the configurable golfing apparatus.

13. The configurable golfing apparatus of claim 1 wherein the first golf club shaft holder, the second golf club shaft holder, the golf club shaft and the golf club head connection component are inserted during a manufacturing process, are integral to the hollow rectangular gripping portion of the configurable golfing apparatus, and are permanently attached to the configurable golfing apparatus.

14. The configurable golfing apparatus of claim 1 further including a second hollow gripping portion for enclosing the golf club shaft comprising: a hollow hockey stick shaped portion, hollow lacrosse stick shaped portion, a hollow baseball bat shaped portion, a hollow circular, oval, square, triangle, polygon including: a pentagon, hexagon, heptagon, octagon, shaped portion or a hollow graduated shape portion including a hollow small-to-large graduated shaped portion or a hollow large-to-small graduated shaped portion.

15. The configurable golfing apparatus of claim 1 further including one or more weights with a pre-determined size and shape to easily and securely slide inside the hollow rectangular gripping portion allowing a golf club head attached to the exemplary configurable golfing apparatus to strike a golf ball with a greater force.

16. The configurable golfing apparatus of claim 1 further including one or more magnets allowing metal components including ball markers, golf tee holders can or bottle openers and other metal objects to be temporarily attached to an exterior surface of the hollow rectangular gripping portion.

17. The configurable golfing apparatus of claim 1 further including a transparent material allowing advertising materials or other types of promotional materials to be inserted into the hollow rectangular gripping portion to advertise or promote goods or services on one or more of the four sides hollow rectangular gripping portion.

18. The configurable golfing apparatus of claim 1 further including a lighting component visible on one or more of the four sides of the hollow rectangular gripping portion comprising: incandescent light bulbs, Light Emitting Diodes (LED) light bulbs or other types of lighting components, on and off switch component and a battery component connected with an electrical circuit.

19. The configurable golfing apparatus of claim 1 further including one or more audio components, including wireless speakers, one or more visual components including a display screen, on and off switch component and a battery component connected with an electrical circuit on or within the hollow rectangular gripping portion to accept and play audio information and visual information.

20. The configurable golfing apparatus of claim 1 further including an accelerometer component on or within the hollow rectangular gripping portion used to measure and record a path of the golf head as it is swung and a force by which the configurable golfing apparatus impacts a golf ball and including a stroke recording component application for counting each time the accelerometer component exceeds a pre-determined force including a force when the configurable golfing apparatus impacts the golf ball and a wireless component allowing accelerometer component and the stroke recording component application to send accelerometer data and stroke recording data wirelessly to an external network device with one or more processors including a smart phone, wearable network device, electronic tablet, Internet of Things (IoT) network device, laptop computer or desktop computer.

21. The configurable golfing apparatus of claim 1 further including includes one or more raised letters or raised graphical objects on one or more of its four sides of the hollow rectangular gripping portion allowing advertising materials or other types of promotional materials to be displayed directly on the hollow rectangular gripping portion to advertise or promote goods or services on the one or more of the four sides hollow rectangular gripping portion.

22. A configurable golfing apparatus, comprising in combination:

a hollow rectangular gripping portion functioning as a golf club shaft;

a plurality of internal golf club shaft holders placed at desired distances within the hollow rectangular gripping portion, the plurality of internal golf club shaft holders comprising:

a rectangular component;

a circular or oval shaped center component connected within the rectangular component with a circular or oval shaped receptacle engaging and securely holding the golf club shaft, a plurality of support and shock absorbing components connected to the circular or oval shaped center component enclosing a plurality of hollow receptacles, a plurality of other hollow receptacles between the plurality of support and shock absorbing components and the rectangular component, the plurality of support and shock absorbing components and the plurality of other hollow receptacles providing optimal force absorption and optimal shock absorption when a golf club head connected to the golf club shaft is used to strike a golf ball; and a golf club head connection component for dynamically inserting and removing one or more different golf club heads into the hollow rectangular gripping portion, the golf club head connection component attached to a second bottom end of the hollow rectangular gripping portion, the hollow rectangular gripping portion providing a plurality of new rectangular gripping points and positions on the configurable golfing apparatus and complying with cross sectional dimensions, axis of a grip and two grip requirements for golf club grips used by professional golfers, the hollow rectangular gripping portion fully operational as the golf club shaft and complying with straightness, bending and flexibility, twisting and torque, properties and golf club head attachment requirements for golf club shafts used by professional golfers.

23. The configurable golfing apparatus of claim 1 wherein the hollow rectangular gripping portion of the configurable golfing apparatus includes pre-determined dimensions of a smaller size to allow the rectangular gripping portion of the configurable golfing apparatus to be used by teen and child golfers whose hands are smaller than adult golfers.

* * * * *